US011095039B2

(12) United States Patent
Kasahara

(10) Patent No.: US 11,095,039 B2
(45) Date of Patent: Aug. 17, 2021

(54) COMMUNICATION APPARATUS

(71) Applicant: NEC Corporation, Tokyo (JP)

(72) Inventor: Yoshiaki Kasahara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 69 days.

(21) Appl. No.: 16/462,636

(22) PCT Filed: Aug. 22, 2017

(86) PCT No.: PCT/JP2017/029943
§ 371 (c)(1),
(2) Date: May 21, 2019

(87) PCT Pub. No.: WO2018/096470
PCT Pub. Date: May 31, 2018

(65) Prior Publication Data

US 2020/0259265 A1 Aug. 13, 2020

(30) Foreign Application Priority Data

Nov. 25, 2016 (JP) ..... JP2016-228680

(51) Int. Cl.
*H01Q 19/06* (2006.01)
*H01Q 3/44* (2006.01)
(Continued)

(52) U.S. Cl.
CPC ..... *H01Q 19/062* (2013.01); *H01Q 3/44* (2013.01); *H01Q 9/16* (2013.01); *H01Q 15/02* (2013.01); *H01Q 15/12* (2013.01); *H01Q 19/06* (2013.01)

(58) Field of Classification Search
CPC ..... H01Q 19/062; H01Q 3/44; H01Q 9/16; H01Q 15/02; H01Q 1/38; H01Q 15/12; H01Q 19/06
(Continued)

(56) References Cited

U.S. PATENT DOCUMENTS 2,637,847 A * 5/1953 Affel, Jr. ..... H01Q 15/244 343/756
4,201,961 A * 5/1980 Klein ..... H01P 1/174 333/21 A
(Continued)

FOREIGN PATENT DOCUMENTS

CN 103296476 A 9/2013
CN 103594789 A 2/2014
(Continued)

OTHER PUBLICATIONS

Xumin Ding et al., "Metasurface for polarization and phase manipulation of the electromagnetic wave simultaneously", Department of Microwave Engineering, Harbin Institute of Technology, 2016, pp. 393-394 (3 pages total).
(Continued)

*Primary Examiner* — Hai V Tran
(74) *Attorney, Agent, or Firm* — Sughrue Mion, PLLC

(57) ABSTRACT

A communication apparatus (1) includes a radio wave radiation source (10), a phase control plate (11) disposed near the radio wave radiation source, and a polarization control plate (12) disposed to be substantially parallel to the phase control plate (11). In the phase control plate (11), a phase of a transmitted electromagnetic wave differs according to a distance from a first representative point on the phase control plate (11). In the polarization control plate (12), a polarization state change given to a transmitted electromagnetic wave at a reference point differs according to an angle formed between a representative line connecting a second representative point on the polarization control plate (12) to an edge of the polarization control plate (12), and a reference line connecting the second representative point to the reference point on the polarization control plate (12).

46 Claims, 35 Drawing Sheets

(51) Int. Cl.
*H01Q 9/16* (2006.01)
*H01Q 15/02* (2006.01)
*H01Q 15/12* (2006.01)

(58) Field of Classification Search
USPC ..... 343/753
See application file for complete search history.

(56) References Cited

U.S. PATENT DOCUMENTS

| | | | | |
|---|---|---|---|---|
| 2007/0090925 | A1* | 4/2007 | Tanaka | G06K 7/0008 340/10.1 |
| 2009/0079637 | A1* | 3/2009 | Fukui | H01Q 11/04 343/700 MS |
| 2010/0085263 | A1* | 4/2010 | Yano | H01Q 21/064 343/771 |
| 2010/0231475 | A1* | 9/2010 | Ou | H01Q 13/0258 343/776 |
| 2019/0260135 | A1* | 8/2019 | Kasahara | H01Q 13/02 |

FOREIGN PATENT DOCUMENTS

| | | | |
|---|---|---|---|
| JP | 4079171 | B2 | 4/2008 |
| JP | 2015-231182 | A | 12/2015 |

OTHER PUBLICATIONS

Farman Ali Mangi et al., "Manipulating Electromagnetic Wave Linear-to-Circular Polarization Conversion Transmitter Based on Periodic Strips Array", 2016 3rd International Conference on Information Science and Control Engineering, 2016, pp. 1342-1345 (5 pages total).

International Search Report dated Nov. 14, 2017, in counterpart international Application No. PCT/JP2017/029943.

Japanese Office Action for JP Application No. 2018-552408 dated May 11, 2021 with English Translation.

* cited by examiner x
y

COMMUNICATION APPARATUS

This application is a National Stage Entry of PCT/JP2017/029943 filed on Aug. 22, 2017, which claims priority from Japanese Patent Application 2016-228680 filed on Nov. 25, 2016, the contents of all of which are incorporated herein by reference, in their entirety.

TECHNICAL FIELD

The present invention relates to a communication apparatus.

BACKGROUND ART

There has been proposed a communication apparatus (for example, a millimeter-wave antenna) which realizes high directivity through a combination of a radio wave radiation source (for example, a horn antenna) and a lens (for example, a dielectric lens). In the communication apparatus, it is necessary to increase an effective aperture area of the lens in order to realize the high directivity. Typically, in the configuration using the radio wave radiation source and the dielectric lens, a horn antenna is used as the radio wave radiation source. In the horn antenna, it is necessary to increase a distance between a radio wave radiation source and a lens in order to increase an effective aperture area. The dielectric lens has a certain amount of thickness. As a result, the whole thickness is increased, and thus there is a problem in which a communication apparatus is large-sized.

As a technique of solving the problem, Patent Document 1 discloses an antenna apparatus having a dielectric lens. The dielectric lens is formed of a rotationally symmetric body having an optical axis as a rotation center, and has plural front-surface-side refractive surfaces in a concentric circle shape in which a front surface which is the surface on the opposite side to a primary radiator side protrudes in the front surface direction, and step difference surfaces connecting adjacent front-surface-side refractive surfaces to each other. The step difference surfaces form an angle within a range of ±20 degrees with respect to a main light beam which is incident to any position in a rear surface facing the primary radiator from a focal point and advances through the lens, and plural curved surfaces in a concentric circle shape are provided by zoning at a position of the main light beam passing through a front-surface-side refractive surface in the rear surface. By using such a shape, zoning is possible without changing an effective aperture surface distribution, and thus thinning of a lens portion is realized.

RELATED DOCUMENT

Patent Document

[Patent Document 1] Japanese Patent No. 4079171

SUMMARY OF THE INVENTION

Technical Problem

However, according to the technique disclosed in Patent Document 1, the lens portion can be thinned, but a distance between the radio wave radiation source and the lens cannot be reduced. The lens processing accuracy is increased, and this causes a problem such as a cost increase.

An object of the present invention is to realize thinning of a communication apparatus.

Solution to Problem

According to the present invention, there is provided a communication apparatus including a radio wave radiation source that radiates an electromagnetic wave; a phase control plate that is disposed near the radio wave radiation source; and a polarization control plate that is disposed to be parallel to the phase control plate, in which, in the phase control plate, a phase of a transmitted electromagnetic wave differs according to a distance from a first representative point on the phase control plate, and in which, in the polarization control plate, a polarization state change given to a transmitted electromagnetic wave at a reference point differs according to an angle formed between a representative line connecting a second representative point on the polarization control plate to an edge of the polarization control plate, and a reference line connecting the second representative point to the reference point on the polarization control plate.

Advantageous Effects of Invention

According to the present invention, it is possible to realize thinning of a communication apparatus.

BRIEF DESCRIPTION OF THE DRAWINGS

The above-described object, and other objects, features, and advantages will become apparent throughout preferable example embodiments described below and the accompanying drawings.

DESCRIPTION OF EMBODIMENTS

Figure 1:
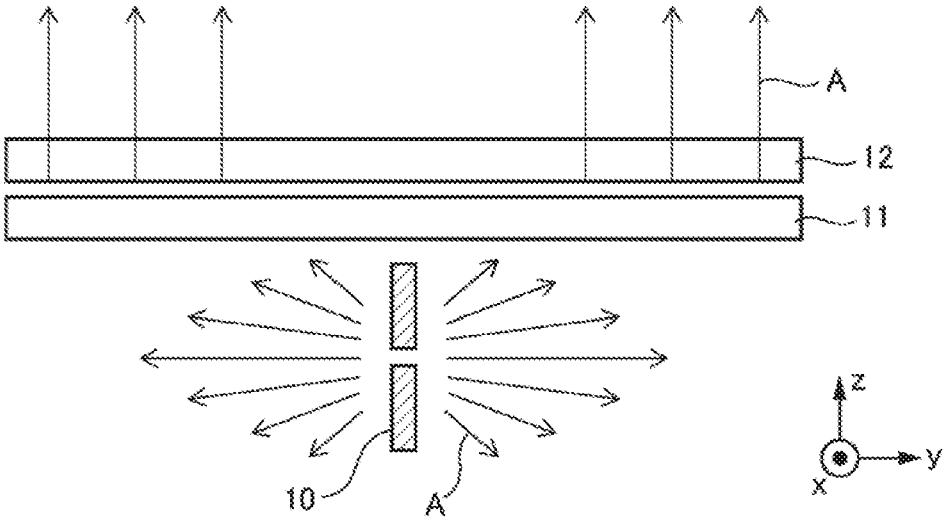
FIG. 1 is an example of the overall schematic diagram of a communication apparatus of the present example embodiment.

FIG. 1 is a schematic diagram illustrating a communication apparatus 1 of the present example embodiment. The communication apparatus 1 is, for example, an antenna apparatus (for example, a millimeter-wave antenna). As illustrated, the communication apparatus 1 includes a radio wave radiation source 10, and control plates (a phase control plate 11 and a polarization control plate 12 which are substantially parallel to each other). In the figure, an arrow A indicates an advancing direction of an electromagnetic wave. The radio wave radiation source 10 of the present example embodiment has directivity which is isotropic (non-directional) and is high in a plane (xy plane) substantially parallel to the phase control plate 11. A radio wave radiated from the radio wave radiation source 10 can widely spread without requiring a distance in a z direction due to the directivity feature of the radio wave radiation source 10. Thus, the radio wave radiation source 10 can supply power to the phase control plate 11 close thereto in a wide range.

The phase control plate 11 is disposed near the radio wave radiation source 10 in substantial parallel to a plane in which radio wave radiation intensity of the radio wave radiation source 10 is non-directional. In this case, the term "near" indicates a distance within 10λ, and more preferably 8λ, or 5λ, in a case where a wavelength of an electromagnetic wave at an operation frequency of the radio wave radiation source 10 is indicated by k.

The phase control plate 11 has a diameter of $L_1/2$ or more, and more preferably $L_1$ or more with respect to a distance $L_1$ to the radio wave radiation source 10. The radio wave radiation source 10 has the directivity feature of being able to supply power up to a position separated from a first representative point (definition of the first representative point will be described later) on the phase control plate 11 by $L_1/2$.

Here, the phrase "being able to supply power" indicates that, for example, 1/10 or more of radiated power of the radio wave radiation source 10 is able to be supplied to the phase control plate 11. In a case where an antenna, typically used, radiating a radio wave in the z direction is used as the radio wave radiation source 10, if the radio wave radiation source 10 and the phase control plate 11 are close to each other, power reaches only a central portion of the phase control plate, and an effective aperture area is reduced such that a high-directivity beam cannot be formed. Since the radio wave radiation source 10 of the present example embodiment has directivity which is isotropic and is high in an xy plane, a radio wave spreads inward the xy plane, that is, inward a surface of the phase control plate 11, and thus power can be supplied to a wide range of the phase control plate 11 even in a case where the radio wave radiation source 10 is disposed near the phase control plate 11. Thinning of the communication apparatus 1 is achieved due to this feature. In order to form a high-directivity beam, among electromagnetic waves radiated from the radio wave radiation source 10, phases of electromagnetic waves incident to the phase control plate 11 are aligned with each other by the phase control plate 11. A high-directivity beam which advances in an upward direction (z axis positive direction) in the figure is formed by the phase control plate 11. Since polarization states of electromagnetic waves incident to the phase control plate 11 are different from each other depending on locations, the polarization states are required to be aligned with each other, and this function is achieved by the polarization control plate 12. Among electromagnetic waves of which phases are aligned with each other by the phase control plate 11, polarization states of electromagnetic waves incident to the polarization control plate 12 are aligned with each other by the polarization control plate 12.

Figure 2:
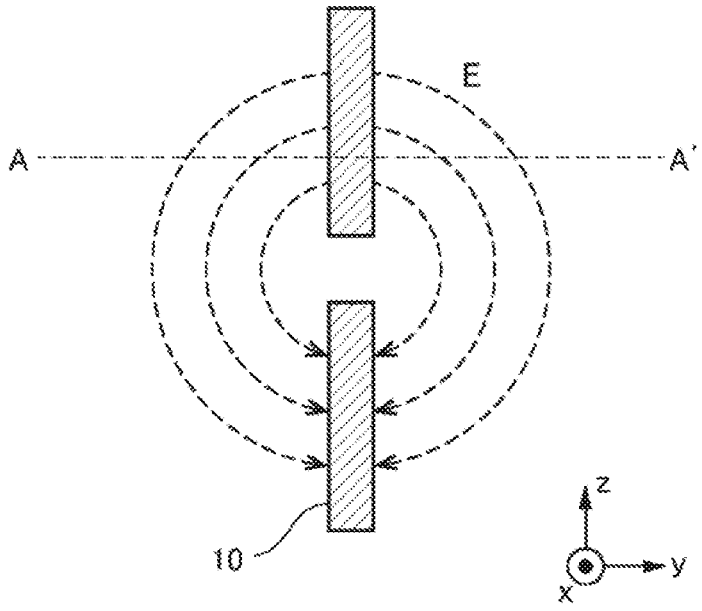
FIG. 2 is a diagram for explaining a function of the communication apparatus of the present example embodiment.
Figure 3:
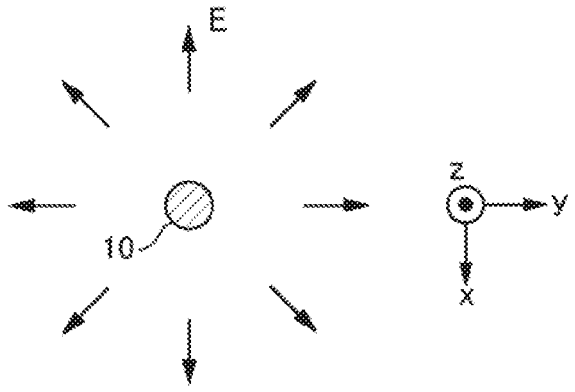
FIG. 3 is a diagram for explaining a function of the communication apparatus of the present example embodiment.

Since a polarization surface of an electromagnetic wave is orthogonal to an advancing direction of the electromagnetic wave, the radio wave radiation source 10 having isotropic directivity in the xy plane (a plane substantially parallel to the phase control plate 11) radiates electromagnetic waves in which electric fields or magnetic fields are radially distributed in the xy plane with the z axis as a central axis. FIGS. 2 and 3 illustrate aspects of electric fields of a dipole antenna as an example of an antenna having isotropic directivity in the xy plane. For example, as the radio wave radiation source 10, a dipole antenna which is disposed (of which an extension direction is) to be substantially perpendicular to the phase control plate 11 may be used. Electric fields E of the dipole antenna are distributed in a yz plane including the dipole antenna as illustrated in FIG. 2, and, above all, in a case where, for example, a section taken along the line A-A' is extracted, the electric fields E are distribution as illustrated in FIG. 3. In other words, it can be seen that the electric fields E are radially distributed. In this polarization state, even though phases of electromagnetic waves are aligned by the phase control plate 11, and thus a high-directivity beam advancing in the z axis positive direction is formed, since electric field vectors directed toward a radial direction overlap each other on a central axis (a direct upper side of the dipole antenna) of the beam, as a result of interference, a hole of an electric field intensity distribution is generated at the center of the beam. Thus, in order to provide a thinning, high-directivity antenna in the present example embodiment, polarized waves of electromagnetic waves are preferably aligned with each other, and this function is achieved by the polarization control plate 12. In other words, phases of radial polarized waves of electromagnetic waves radiated from the radio wave radiation source 10 are aligned with each other as a result of the electromagnetic waves being transmitted through the phase control plate 11 and are aligned into a single polarized wave as a result of the electromagnetic waves being transmitted through the polarization control plate 12.

Hereinafter, a description will be made of an example of a method of implementing the phase control plate 11 aligning phases and an example of a method of implementing the polarization control plate 12 aligning polarized waves.

First, a description will be made of a method of aligning phases. A point on the phase control plate 11 closest to the radio wave radiation source 10 is set as the first representative point. A radio wave reaching the first representative point from the radio wave radiation source 10 reaches the phase control plate 11 at the shortest optical path length. Radio waves reaching the phase control plate 11 from the radio wave radiation source 10 arrives following optical paths with different lengths due to locations, and thus the phase control plate 11 is configured to give different phase delays according to distances from the first representative point. The first representative point is preferably located near the center of a front surface of the phase control plate 11.

The phase control plate 11 may be configured, for example, by arranging unit structures giving different phase delays according to distances from the first representative point on the phase control plate 11. The "first representative point" is a point on the front surface (a surface facing the radio wave radiation source 10) of the phase control plate 11. The "distance from the first representative point" is a distance from the first representative point on the front surface. Specifically, the phase control plate 11 is configured to give a smaller phase delay amount toward an edge of the phase control plate from the first representative point. The description is made supposing that a phase range is not limited to a range of 360 degrees. The phase delay amount indicates a phase difference between an incidence surface (a surface facing the radio wave radiation source 10) and an emission surface (a surface opposite to the surface facing the radio wave radiation source 10) of the phase control plate 11. The function is realized by arranging plural types of unit structures having different performances in a predetermined order. Hereinafter, a description thereof will be made.

In the phase control plate 11 realizing the function, a unit structure group giving an identical phase delay to transmitted electromagnetic waves surrounds the periphery of the first representative point. Each of plural types of unit structure groups giving different phase delay amounts to transmitted electromagnetic waves surrounds the periphery of the first representative point. Note that the "identical amount" is a concept including not only completely matching but also an amount including an error (a variation in a phase delay amount due to a processing error, an etching error, or the like). A difference in a phase amount deviated between unit structures of a unit structure group deviating phases of transmitted electromagnetic waves by an identical amount is, for example, 45 degrees or less, and is more preferably 30 degrees or 15 degrees or less.

In a case where the phase control plate 11 and the surface of the radio wave radiation source 10 having isotropic directivity are substantially parallel to each other, a unit structure group giving an identical phase delay to transmitted electromagnetic waves is circularly disposed centering on the first representative point. Plural types of unit structure groups giving different phase delays to transmitted electromagnetic waves are concentrically arranged centering on the first representative point.

Figure 4:
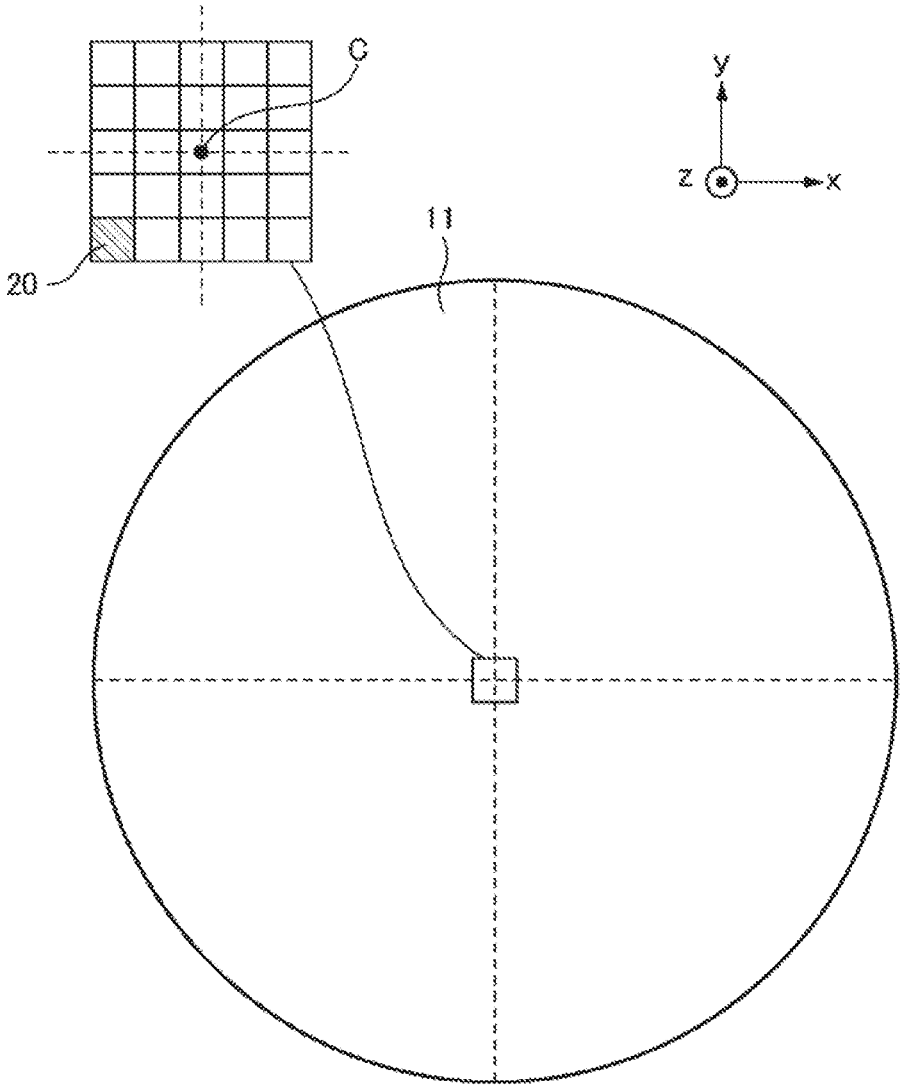
FIG. 4 is a diagram for explaining an example of a method of arranging unit structures.
Figure 5:
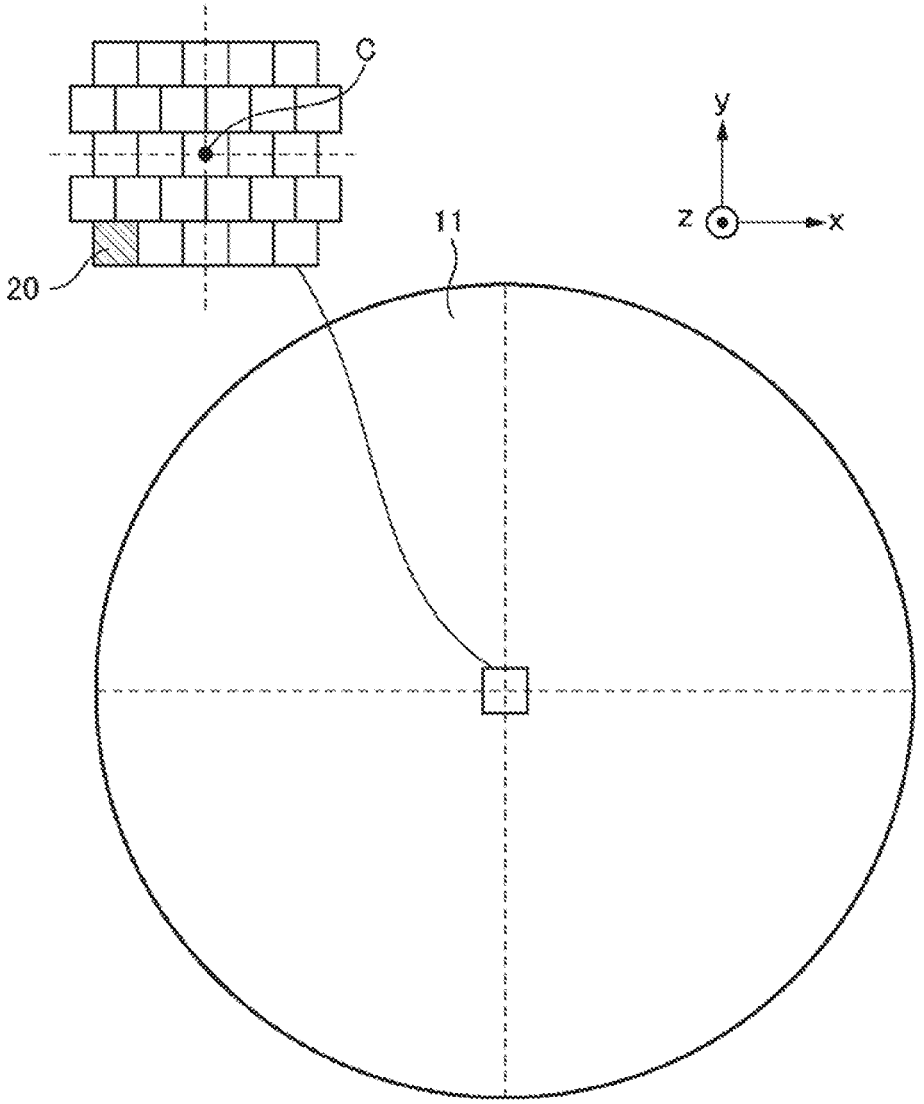
FIG. 5 is a diagram for explaining an example of a method of arranging unit structures.
Figure 6:
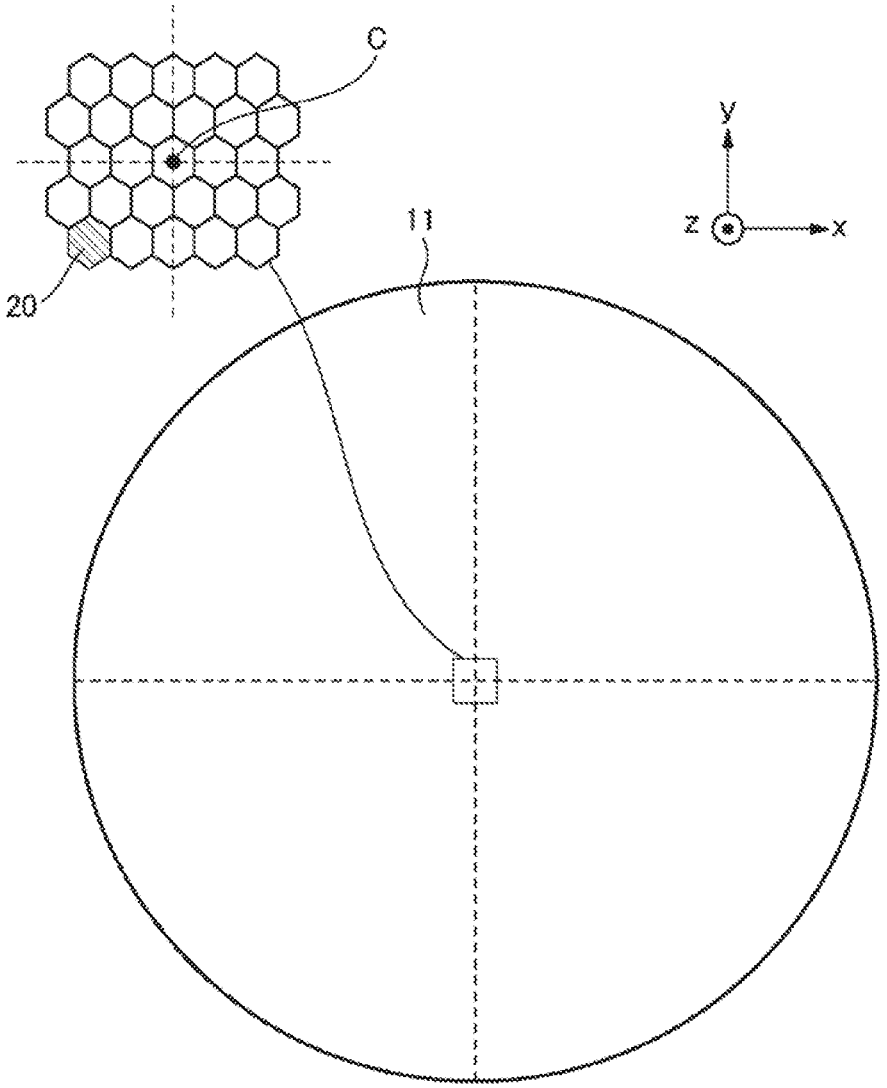
FIG. 6 is a diagram for explaining an example of a method of arranging unit structures.

For example, as illustrated in FIGS. 4, 5, and 6, a reference point (for example, the center of a unit structure 20) is defined for each of plural arranged unit structures 20, and a distance N between the reference point and a first representative point C of the phase control plate 11 is computed with respect to each unit structure 20. Plural unit structures are grouped according to a value of N. For example, the unit structures 20 satisfying each of plural numerical value conditions such as $n0 \leq N \leq n1$, $n1 < N \leq n2$, $n2 < N \leq n3$, . . . may be included in an identical group. Configurations and characteristics of plural unit structures 20 in an identical group are assumed to be same as each other. Consequently, the circular and concentric arrangements can be realized.

Note that characteristics of unit structures of each group may be determined such that phase delay amounts of radio waves transmitted through the phase control plate 11 are reduced with respect to phases of radio waves incident to the phase control plate 11 according to an increase of a value of N such as $n0 \leq N \leq n1$, $n1 < N \leq n2$, $n2 < N \leq n3$, . . . . In this case, a phase delay amount starts from a first reference value, and the phase delay amount is reduced by a predetermined amount according to an increase of a value of N.

The phase control plate 11 includes, for example, a metal pattern layer which is a meta-surface (an artificial sheet-like material formed by using the concept of meta-material) and is formed of one or plural layers. In a case where the phase control plate 11 is formed of plural layers, each of the plural layers has a metal pattern. Note that, for example, a dielectric is present in a portion other than the metal pattern.

The metal pattern of the metal pattern layer has a structure in which plural types of unit structures configured to include metals are arranged in a two-dimensional manner with a predetermined rule or at random. A size of the unit structure is sufficiently smaller than a wavelength of an electromagnetic wave. Thus, a set of unit structures functions as an electromagnetic continuous medium. A permeability and a dielectric constant are control by using a structure of a metal pattern, and thus a refractive index (phase velocity) and impedance can be controlled separately. A phase constant is controlled while matching a vacuum impedance value with an impedance value of the phase control plate (that is, while maintaining a non-reflection condition), so that a delayed phase shift amount can be controlled in the phase control plate, and thus phases of electromagnetic waves which are radiated from the radio wave radiation source 10 and are incident to the phase control plate 11 can be aligned with each other in the phase control plate 11.

Note that the phase control plate 11 of the present example embodiment may be implemented by a dielectric lens.

Figure 21:
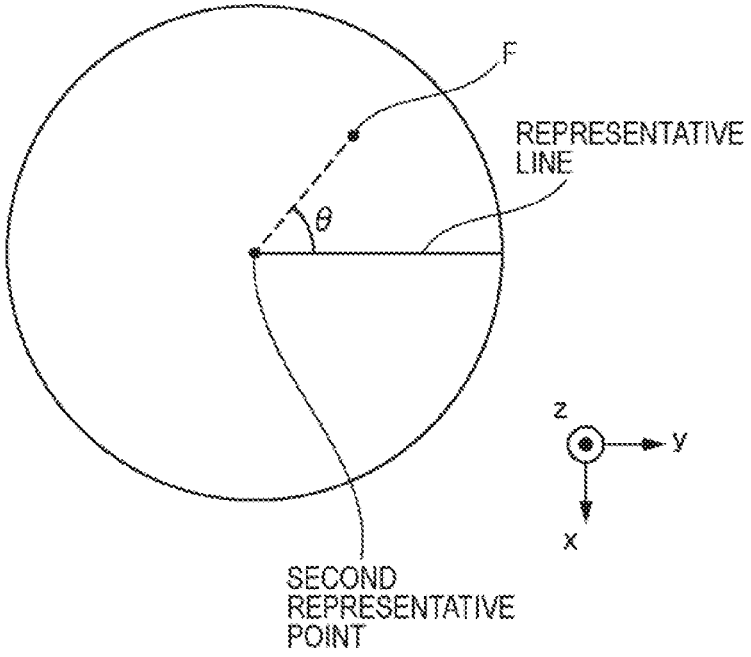
FIG. 21 is a diagram for explaining a function of the communication apparatus of the present example embodiment.

Next, a description will be made of a method of aligning polarized waves with each other. In other words, a description will be made of an example of a method of implementing the polarization control plate 12 aligning polarized waves. A point where a perpendicular line drawn from a radio wave radiation point of the radio wave radiation source 10 in a perpendicular direction to the surface of the radio wave radiation source 10 having isotropic directivity from the radio wave radiation source 10 intersects the polarization control plate 12 is referred to as a second representative point, and a line drawn from the second representative point toward an edge of the polarization control plate 12 is referred to as a representative line. This scene is illustrated in FIG. 21. In a case where a certain location (reference point) on the polarization control plate 12 is indicated by a point F, the polarization control plate 12 is configured to perform control of different polarization states according to an angle (an angle θ in FIG. 21) formed between a line (reference line) connecting the point F to the second representative point and the representative line. The second representative point is preferably located near the center of the front surface of the polarization control plate 12.

The polarization control plate 12 may be implemented, for example, by arranging unit structures performing control of different polarization states in the surface of the polarization control plate 12 in a predetermined order from the second representative point on the polarization control plate 12. A difference between phase delay amounts of two orthogonal polarization components may be controlled in controlling a polarized wave of an electromagnetic wave.

Figure 22:
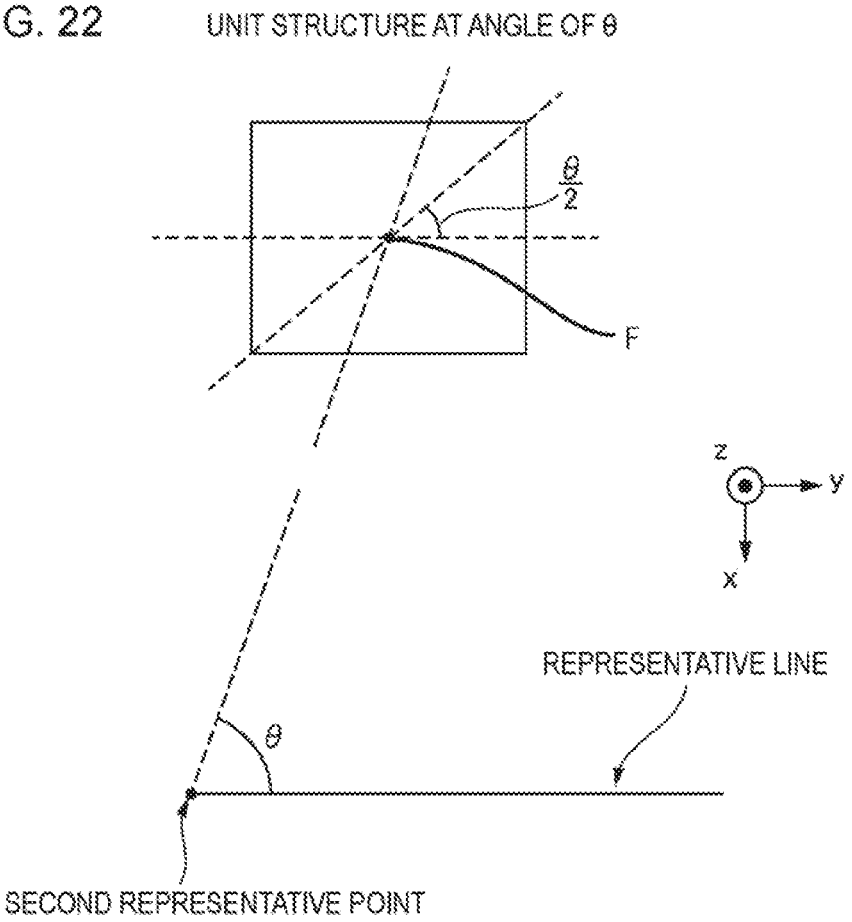
FIG. 22 is a diagram for explaining a function of the communication apparatus of the present example embodiment.

The polarization control plate 12 may be configured, for example, by arranging unit structures giving different phase delays according to an angle with the representative line on the polarization control plate 12. The "representative line" is a line on the front surface (a surface facing the radio wave radiation source 10) of the polarization control plate 12. The "angle with the representative line" is an angle formed between the representative line on the front surface and a line (reference line) connecting the point F to the second representative point. Specifically, in converting radial polarization states into linear polarization states aligned into one direction, the polarization control plate 12 is configured by arranging a unit structure having a characteristic in which, with respect to the angle θ with the representative line, a difference between a phase delay amount given in a direction of an angle of θ/2 degrees and a phase delay amount given in a direction of an angle of (θ/2+90) degrees is 180 degrees (π) (refer to FIG. 22). The phase delay amount indicates a phase difference between an incidence surface (a surface facing the radio wave radiation source 10) and an emission surface (a surface opposite to the surface facing the radio wave radiation source 10) of the polarization control plate 12. Specifically, in converting radial polarization states into an identical circular polarized wave, the polarization control plate 12 is configured by arranging a unit structure having a characteristic in which, with respect to the angle θ with the representative line, a difference between a phase delay amount given in a direction of an angle of (θ+45) degrees and a phase delay amount given in a direction of an angle of (θ+135) degrees is a difference of 90 degrees (π/2) or −90 degrees (−π/2). The function is realized by arranging plural types of unit structures having different performances in a predetermined order. Hereinafter, a description thereof will be made.

In the polarization control plate 12 realizing the function, a unit structure group controlling a polarization state of a transmitted electromagnetic wave surrounds the periphery of the second representative point. Each of plural types of unit structure groups performing control of different polarization states on transmitted electromagnetic waves surrounds the periphery of the second representative point. Note that the "control of identical polarization state" is a concept including not only completely matching but also including an error (a variation in a polarization state control amount due to a processing error, an etching error, or the like). The control of a polarization state is performed by phase control amounts for two axes orthogonal to each other in a plane substantially parallel to the polarization control plate 12 being different from each other. A difference between the phase control amounts for the two axes varies, and thus a variation occurs in a polarization state control amount. Note that a difference in a phase delay between the two axes, deviated between unit structures of a unit structure group giving an identical polarization state change to transmitted electromagnetic waves is, for example, 45 degrees or less, and is more preferably 30 degrees or 15 degrees or less.

In a case where the polarization control plate 12 and the surface having isotropic directivity of the radio wave radiation source 10 are substantially parallel to each other, a unit structure group performing control of an identical polarization state on transmitted electromagnetic waves is linearly disposed in the edge direction of the polarization control plate 12 from the second representative point. Plural types of unit structure groups performing control of different polarization states on transmitted electromagnetic waves are radially arranged centering on the second representative point. Note that a difference in a phase delay between the two axes, deviated between unit structures in a unit structure group giving an identical polarization state change to transmitted electromagnetic waves is, for example, 45 degrees or less, and is more preferably 30 degrees or 15 degrees or less.

Figure 33:
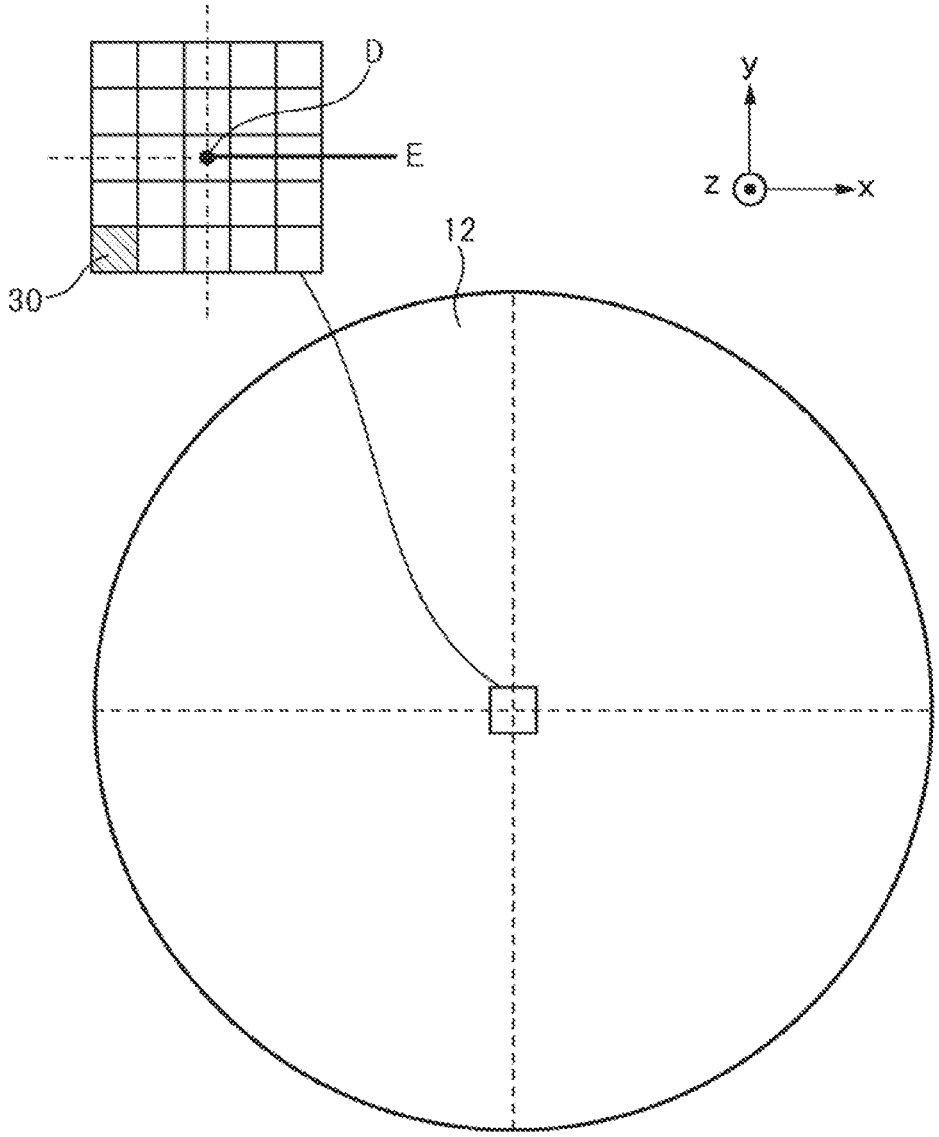
FIG. 33 is a diagram for explaining an example of a method of arranging unit structures.

For example, as illustrated in FIG. 33, a reference point (for example, the center of a unit structure 30) is defined for each of plural arranged unit structures 30, and an angle θ formed between a straight line (reference line) connecting the reference point to a second representative point D and a representative line E of the polarization control plate 12 is computed with respect to each unit structure 30. Here, the formed angle θ is, for example, an angle measured counterclockwise from the reference line of angles formed between the reference line and the representative line E. Plural unit structures are grouped according to a value of θ. For example, the unit structures 30 satisfying each of plural numerical value conditions such as $m0 \le \theta \le m1$, $m1 < \theta \le m2$, $m2 < \theta \le m3$, . . . may be included in an identical group. Configurations and characteristics of plural unit structures 30 in an identical group are assumed to be same as each other. Consequently, the radial arrangement can be realized.

Note that a direction of a fast axis (of two axes to which unit structures give different phase delays, an axis for which a phase delay amount is smaller) of a unit structure of the polarization control plate 12 may be determined according to a value of θ such as $m0 \le \theta \le m1$, $m1 < \theta \le m2$, $m2 < \theta \le m3$, . . . . In this case, in order to align polarization states after passing through the polarization control plate 12 into linear polarized waves, a direction of a fast axis is set to θ/2 with respect to θ. In this case, a direction of a slow axis (of two axes to which unit structures give different phase delays, an axis for which a phase delay amount is larger) is (θ/2+90) degrees, and a difference between phase delay amounts for the fast axis and the slow axis is 180 degrees. In order to align polarization states after passing through the polarization control plate 12 into circular polarized waves, a direction of a fast axis is set to (θ+45) degrees with respect to θ. In this case, a direction of a slow axis is (θ+135) degrees, and a difference between phase delay amounts for the fast axis and the slow axis is 90 degrees. The two axes are preferably orthogonal to each other, but are not necessarily orthogonal to each other, and is a concept of including an error to some extent. For example, an angle formed between the fast axis and the slow axis is within 90 degrees±45 degrees, and is more preferably 90 degrees±30 degrees or 90 degrees±15 degrees.

The polarization control plate 12 includes, for example, a metal pattern layer which is a meta-surface (an artificial sheet-like material formed by using the concept of a metamaterial) and is formed of one or plural layers. In a case where the polarization control plate 12 is formed of plural layers, each of the plural layers has a metal pattern. Note that, for example, a dielectric is present in a portion other than the metal pattern.

Here, a description will be made of an example of a meta-surface implementing the phase control plate 11 and the polarization control plate 12. Note that a description made below is only an example, and there is no limitation thereto.

Figure 7:
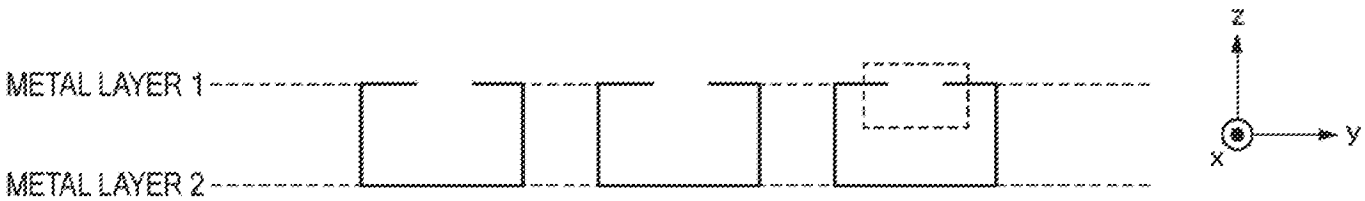
FIG. 7 is a diagram for explaining an example of a metal pattern.

First, with reference to FIG. 7, a description will be made of an example of a structure of a metal pattern layer for controlling permeability. FIG. 7 is a diagram illustrating a structure of a so-called split ring resonator. A metal pattern layer for controlling permeability is formed of two metal pattern layers. The metal pattern layer extends in an xy plane in the figure. A z direction in the figure is a laminate direction of the two layers. A linear or tabular metal is formed in a lower layer. Two linear or tabular metals separate from each other are formed in an upper layer. Each of the upper two metals is connected to an identical metal of the lower layer through, for example, a via. As illustrated, the lower one metal, the upper two metals, and two vias are connected to each other so as to form an annular metal (split ring) of which a part is open when viewed from an x direction. FIG. 7 illustrates a scene in which such split ring structures are arranged in a y direction. The split ring structures may be arranged in the x direction.

In the structure, in a case where a magnetic field Bin having a component in the x direction is applied, an annular current Jind flows along the split ring. The split ring is described by using a series LC resonator circuit model. An inductance L forming a series LC resonator may be adjusted by adjusting a thickness, a width, and a length in a circumferential direction of the annular metal. A capacitance C may be adjusted by adjusting a width or the opening portion (a portion surrounded by a dashed line in FIG. 7) of the annular metal, a line width of the metal, or the like. The current Jind may be adjusted by adjusting L and C. A magnetic field generated by the current Jind may be adjusted by adjusting the current. In other words, the permeability can be controlled. On the other hand, even though the magnetic field Bin having a component in the y direction is applied, a current does not flow through the split ring, and the permeability is not controlled. In other words, the permeability is controlled according to a direction of a magnetic field, and thus the permeability can be controlled so as to obtain polarized wave dependency. Thus, the structure illustrated in FIG. 7 may be used not only as a structure configuring the phase control plate 11 controlling a phase but also as a structure configuring the polarization control plate 12 controlling a polarized wave.

Figure 8:
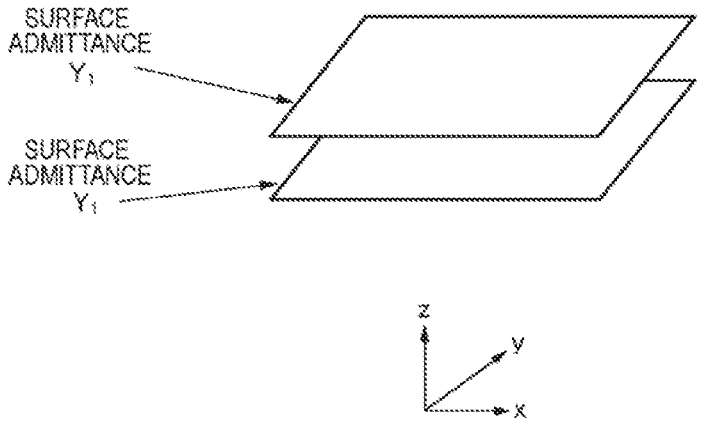
FIG. 8 is a diagram for explaining an example of a metal pattern.

With reference to FIG. 8, a description will be made of another example of a structure of a metal pattern layer for controlling the permeability. The metal pattern layer for controlling the permeability is configured by disposing two metal pattern layers to face each other in different layers. Two metal pattern layers extend in planes parallel to the xy plane in the figure. Each metal pattern layer has a metal pattern for controlling impedance (admittance). When a magnetic field Bin having a component parallel to the two metal pattern layers is applied between the two metal pattern layers, currents Jind flow in directions opposite to each other in the two metal pattern layers. The currents induced by the magnetic field Bin necessarily flow in opposite directions, and are thus equivalently regarded as annular currents to induce a magnetic field. The current Jind may be adjusted by adjusting admittance values of the two metal pattern layers. A magnetic field generated by the current Jind may be adjusted by adjusting the current. In other words, the permeability can be controlled. Adjustment of the admittance of the metal pattern layer can be realized by adjusting the inductance L or the capacitance C formed by the metal pattern of the metal pattern layer.

In this case, in a case where admittance Y1 has polarized wave dependency (direction dependency in a surface), the metal pattern layers illustrated in FIG. 8 may be used as a structure configuring the polarization control plate 12. For example, when the magnetic field Bin is applied in the x direction in FIG. 8, a current flows on the metal pattern layer in a direction (y direction) orthogonal to the magnetic field, and thus the permeability is controlled. When the magnetic field Bin is applied in the y direction in FIG. 8, a current flows on the metal pattern layer in a direction orthogonal to the magnetic field, that is, in the x direction, and thus the permeability is controlled. Metal patterns are adjusted such that a current flowing in the y direction and a current flowing in the x direction have different admittance values, and thus the permeability can be controlled so as to obtain polarized wave dependency. A current flowing in the y direction and a current flowing in the x direction having different admittance values can be realized by disposing different metal patterns on the metal pattern layer in the x direction and the y direction. Thus, the two metal pattern layers of which admittance values are controlled may be used as a structure which configures the polarization control plate 12, and controls the permeability so as to obtain direction dependency.

Figure 9:
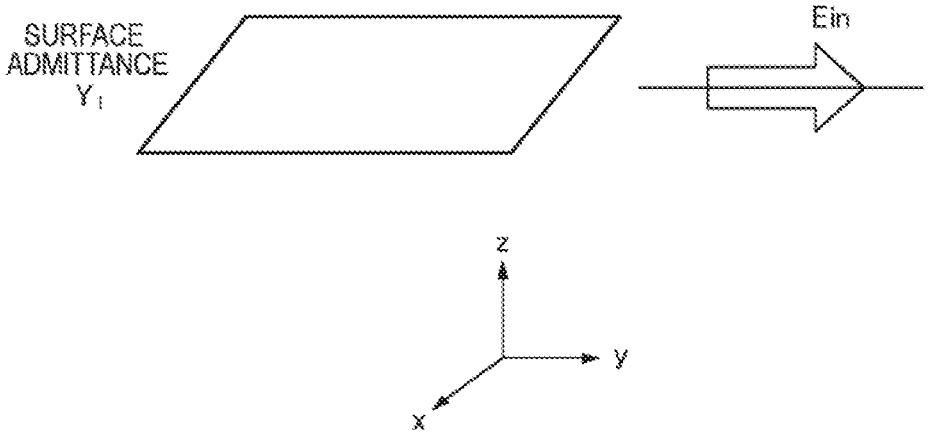
FIG. 9 is a diagram for explaining an example of a metal pattern.

Next, with reference to FIG. 9, a description will be made of an example of a structure of a metal pattern layer for controlling a dielectric constant. A metal pattern layer for controlling a dielectric constant is formed of a single metal pattern layer. A metal pattern layer extends in the xy plane in the figure. The metal pattern layer has a metal pattern for controlling impedance (admittance). A potential difference is induced between two points on an admittance adjustment surface of the metal pattern layer by an electric field Ein in a direction as illustrated in FIG. 9. The current Jind which flows due to the potential difference may be adjusted by adjusting an admittance value of the metal pattern layer, and thus an electric field generated thereby may be adjusted. In other words, a dielectric constant can be controlled.

In this case, in a case where the admittance Y1 has polarized wave dependency, the metal pattern layer may be used as a structure configuring the polarization control plate 12. For example, when the electric field Ein is applied in the y direction in FIG. 9, as described above, a current flows in a direction (y direction) parallel to the electric field on the metal pattern layer, and thus a dielectric constant is controlled. When the electric field Ein is applied in the x direction in FIG. 9, a current flows in a direction parallel to the electric field, that is, in the x direction on the metal pattern layer, and thus a dielectric constant is controlled. Metal patterns are adjusted such that a current flowing in the y direction and a current flowing in the x direction have different admittance values, and thus a dielectric constant can be controlled so as to obtain polarized wave dependency. A current flowing in the y direction and a current flowing in the x direction having different admittance values can be realized by disposing different metal patterns on the metal pattern layer in the x direction and the y direction. Thus, the single metal pattern layers of which an admittance value is controlled may be used as a structure which configures the polarization control plate 12, and controls a dielectric constant so as to obtain direction dependency.

It can be seen from the above description that permeability is controlled by using two metal pattern layers, and a dielectric constant is controlled by using a single metal pattern layer. It can be seen that metal patterns of a metal pattern layer are made different patterns in the x direction and the y direction, and thus permeability and a dielectric constant can be controlled so as to obtain polarized wave dependency. Impedance and a phase constant are given by Equations (1) and (2) as follows by using the dielectric constant and the permeability. As mentioned above, the dielectric constant and the permeability are controlled such that a vacuum impedance value and an impedance value of the phase control plate can be matched with each other (that is, a non-reflection condition can be maintained), and the phase constant is controlled, and thereby a delayed phase shift amount in the phase control plate can be controlled. As described above, such controlled dielectric constant ($\varepsilon eff$) and permeability ($\mu eff$) may have different values depending on directions thereof in a surface of the metal pattern layer. Thus, a polarized wave can be controlled.

$$\eta eff = \sqrt{\frac{\mu eff}{\varepsilon eff}} \tag{1}$$

$$keff = \omega\sqrt{\varepsilon ff\,\mu ff} \tag{2}$$

Figure 10:
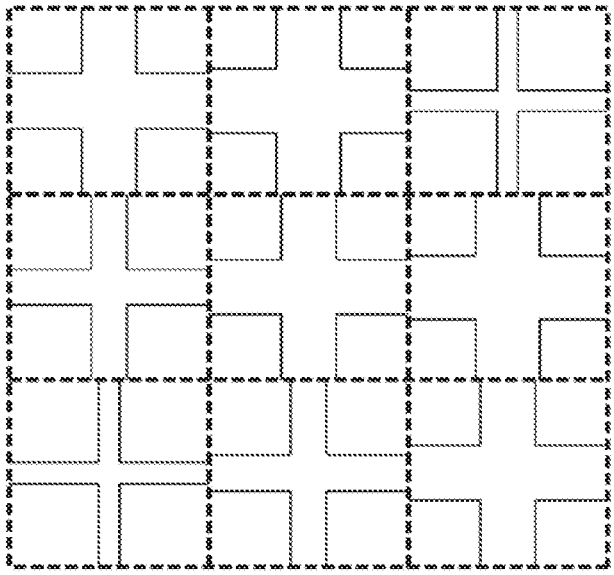
FIG. 10 is a diagram for explaining an example of a metal pattern.

Here, a description will be made of an example of a metal pattern for controlling admittance. FIG. 10 illustrates an example of a metal pattern. As illustrated, metal patterns respectively corresponding to plural unit structures are provided in a single metal pattern layer. A metal pattern of the unit structure may be regarded as a combination of the inductance L extending in the x axis direction and the inductance L extending in y axis direction. The plural unit structures are different among each other in a width of a metal line or the like forming each unit structure. As mentioned above, different metal patterns are formed at different locations, and thus different admittances at different locations can be realized.

Figures 11A, 11B, 11C, 11D:
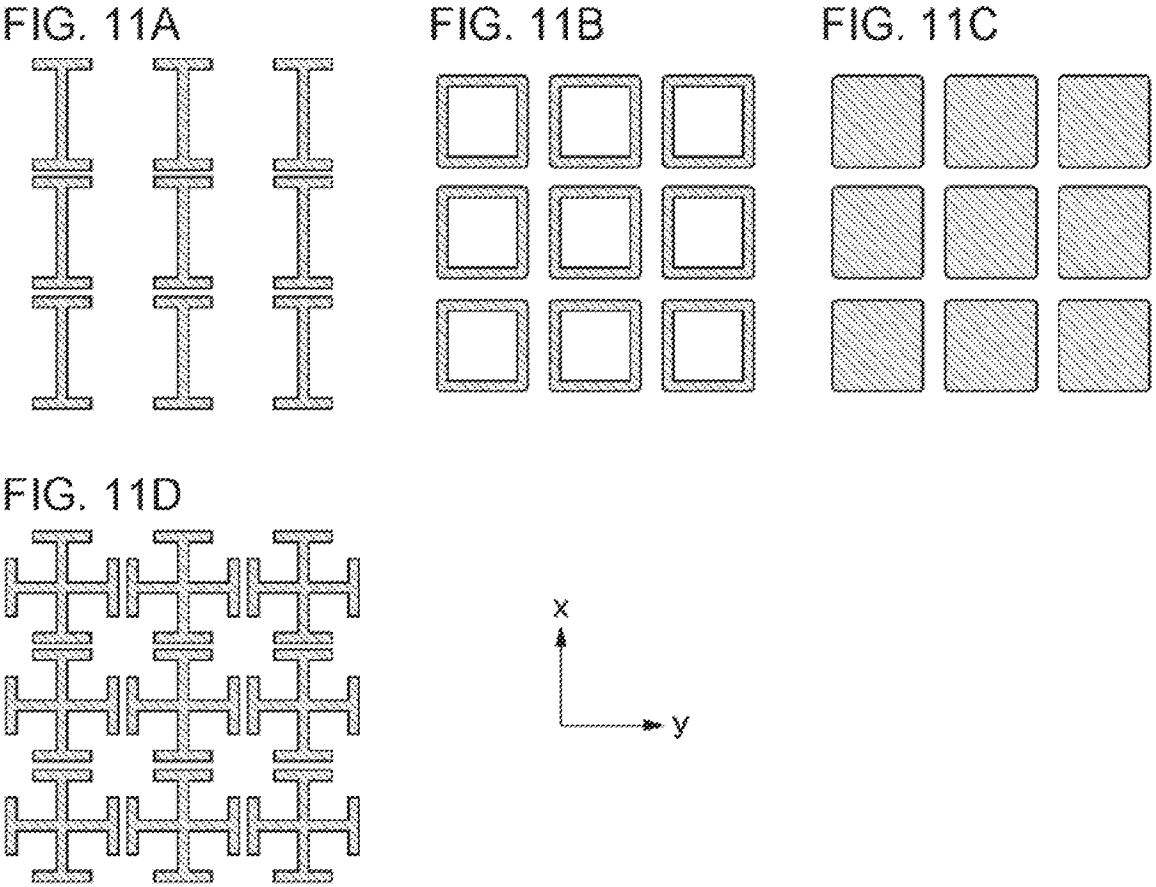
FIGS. 11A-11D are diagrams for explaining an example of a metal pattern.

Here, a description will be made of another example of a metal pattern for controlling admittance. In controlling an admittance value in a wide range from capacitance to inductance, a resonance circuit may be used, and FIG. 11 illustrates an example of a metal pattern for implementing a series resonance circuit. A metal pattern illustrated in FIG. 11(A) is configured by arranging plural linear metals (unit structures) disposed in the same direction as the x axis. The linear metal has line widths of both ends larger than other portions, and capacitance is formed between patterns adjacent to each other in the x axis direction. Note that both ends are not necessarily required to be wide, and may have the same thickness as that of the linear portion or may be thinner than the linear portion as long as a necessary capacitance value can be secured between the patterns adjacent to each other.

FIG. 11(B) is a diagram illustrating a configuration of a metal pattern in which plural quadrangular annular metals (unit structures) each having a side in each of the same direction as and a direction perpendicular to the x axis are arranged. FIG. 11(C) is a diagram illustrating a configuration of a metal pattern in which plural quadrangular island-shaped metals (unit structures) each having a side in each of the same direction as and a direction perpendicular to the electric field E are arranged. FIG. 11(D) is a diagram illustrating a configuration of a metal pattern in which plural cross-shaped metals (unit structures) each having a side in each of the same direction as and a direction perpendicular to the electric field E are arranged.

Figure 12:
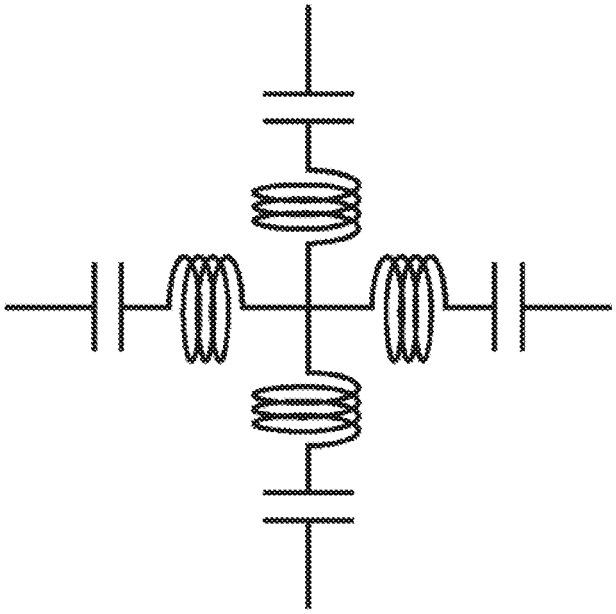
FIG. 12 is a diagram illustrating an equivalent circuit realized by an example of a metal pattern.

Note that the metal patterns in FIGS. 11(B) to 11(D) are configured to perform the same action even in a case where a direction of the electric field E becomes any direction in the xy plane in the figure. A two-dimensional equivalent circuit in this case is as illustrated in FIG. 12.

Figure 13C:
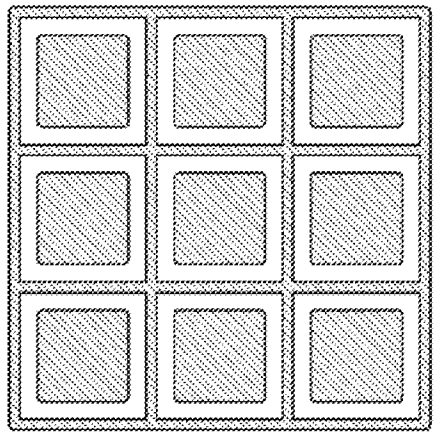
FIG. 13A-13D are diagrams for explaining an example of a metal pattern.
Figure 13B:
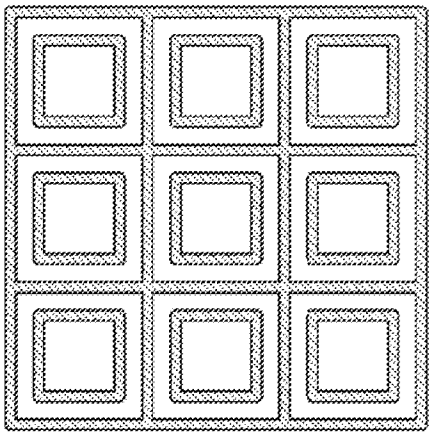
Figure 13A:
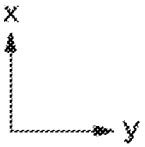
Figure 13A:
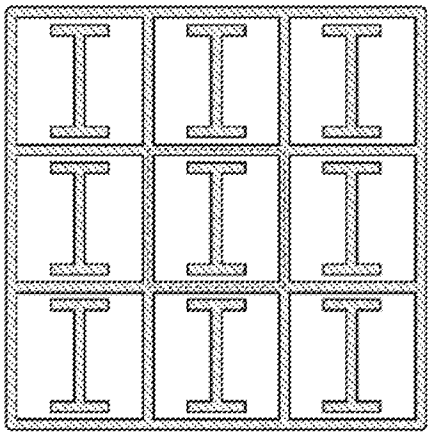
Figure 13D:
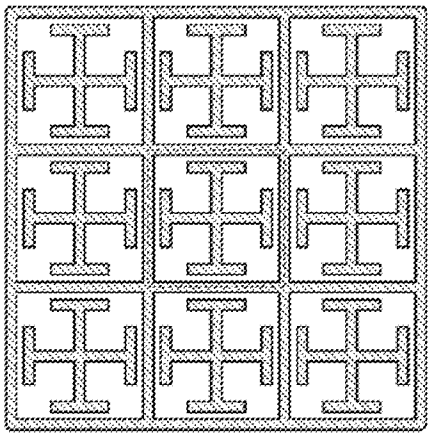

Here, a description will be made of still another example of a metal pattern for controlling admittance. FIG. 13 illustrates an example of a metal pattern for implementing a parallel resonance circuit. FIG. 13(A) is a diagram illustrating a configuration of a metal pattern in which each of the plural linear metals in the metal pattern illustrated in FIG. 11(A) is surrounded by an annular metal having a side in each of the same directions as the x axis and the y axis. FIG. 13(B) is a diagram illustrating a configuration of a metal pattern in which each of the plural quadrangular annular metals in the metal pattern illustrated in FIG. 11(B) is surrounded by an annular metal having a side in each of the same directions as the x axis and the y axis. FIG. 13(C) is a diagram illustrating a configuration of a metal pattern in which each of the plural quadrangular island-shaped metals in the metal pattern illustrated in FIG. 11(C) is surrounded by an annular metal having a side in each of the same directions as the x axis and the y axis. FIG. 13(D) is a diagram illustrating a configuration of a metal pattern in which each of the plural cross-shaped metals in the metal pattern illustrated in FIG. 11(D) is surrounded by an annular metal having a side in each of the same directions as the x axis and the y axis. In FIGS. 13(A) to 13(D), each of plural annular metals surrounding the internal metals illustrated in FIGS. 11(A) to 11(D) shares one side with an annular metal adjacent thereto.

Figure 14:
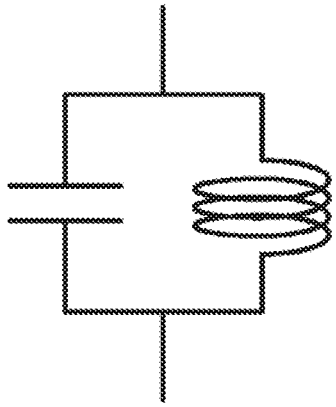
FIG. 14 is a diagram illustrating an equivalent circuit realized by an example of a metal pattern.

Each of the metal patterns illustrated in FIGS. 13(A) to 13(D) acts as a parallel resonance circuit due to the inductance L formed by the annular metal and a series resonator portion in which the capacitance C formed as a result of the annular metal and the metal pattern inside the annular metal being adjacent to each other, the inductance L formed by the metal pattern inside the annular metal, and the capacitance C formed as a result of the annular metal and the metal pattern inside the annular metal being adjacent to each other are connected in series to each other in this order in the vertical direction in the figure. Above all, the series resonator portion in which C, L, and C are connected in series to each other operates as a capacitor up to a resonance frequency of a series resonator. Thus, all of the metal patterns in FIGS. 13(A) to 13(D) come to an equivalent circuit illustrated in FIG. 14. In other words, all of the metal patterns in FIGS. 13(A) to 13(D) realize the equivalent circuit having the relationship illustrated in FIG. 14, that is, a parallel resonance circuit.

Figure 15:
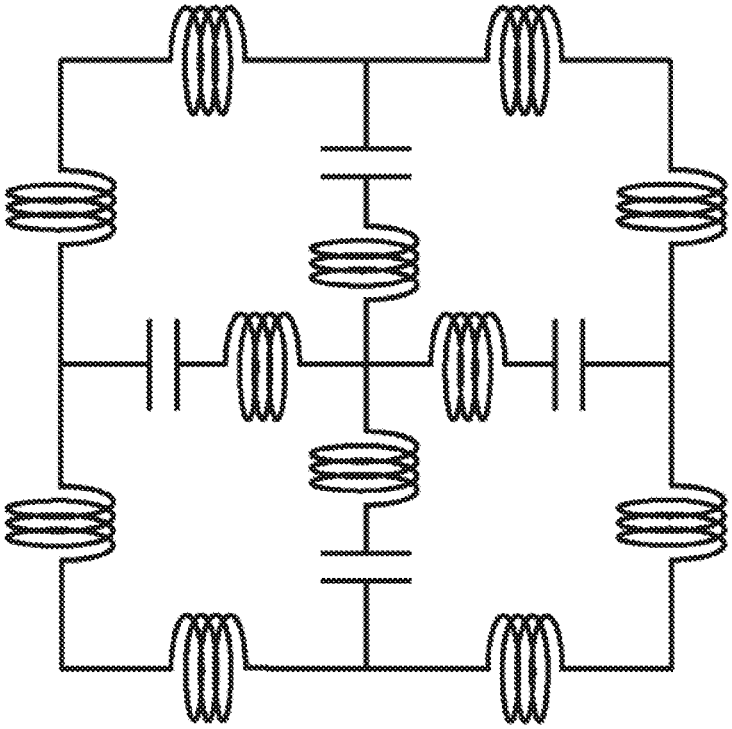
FIG. 15 is a diagram illustrating an equivalent circuit realized by an example of a metal pattern.

Note that the metal patterns in FIGS. 13(B) to 13(D) are configured to perform the same action even in a case where a direction of the electric field E becomes any direction in the xy plane in the figure. A two-dimensional equivalent circuit in this case is as illustrated in FIG. 15.

The metal patterns illustrated in FIGS. 11 and 13 are configured by arranging plural unit structures having an identical shape, but plural different types of unit structures having different lengths of metal lines, thicknesses of metal lines, gaps between metal lines, areas of metal portions, and the like may be arranged.

Figure 16:
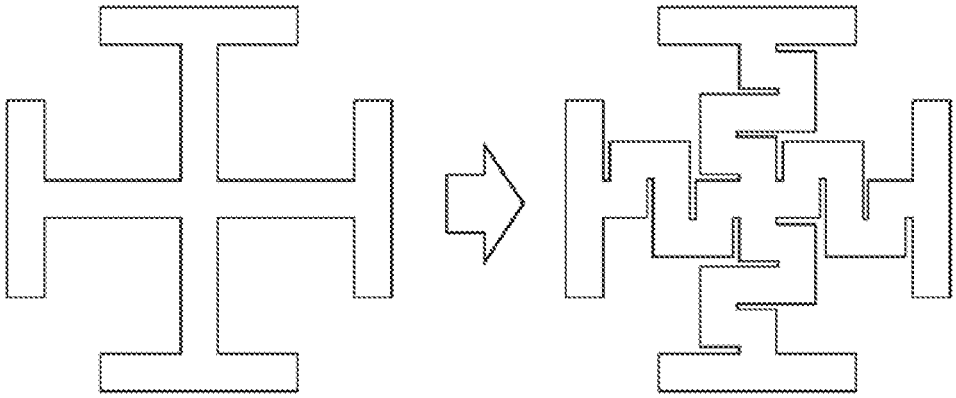
FIG. 16 is a diagram for explaining an example of a metal pattern.
Figure 17:
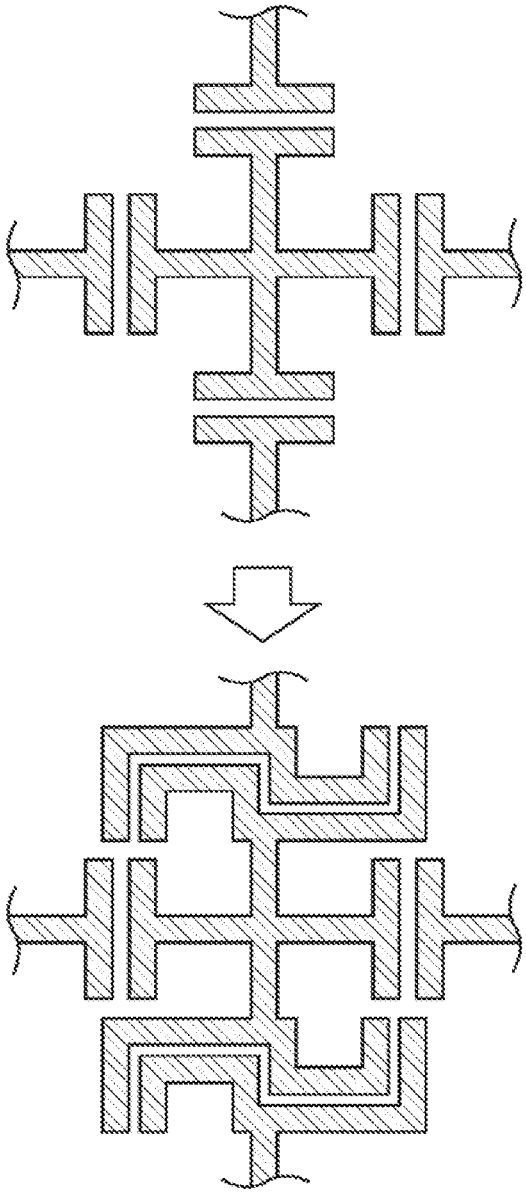
FIG. 17 is a diagram for explaining an example of a metal pattern.

In designing the metal pattern layer, C may be increased by using, for example, an inter-digital capacitor as a capacitor portion. L may be increased by using, for example, a meander inductor or a spiral inductor as an inductor portion. FIG. 16 illustrates a modification example of the cross-shaped metal in FIGS. 11(D) and 13(D). FIG. 17 illustrates a modification example of the cross-shaped metal in FIG. 11(D). In FIG. 16, the linear metal pattern is modified into a meander-shaped metal pattern, and thus an effect that L is increased can be expected, and, in FIG. 17, the facing metal patterns are modified into metal patterns in an inter-digital form, and thus an effect that C is increased can be expected.

Next, a description will be made of an example of a unit structure with reference to FIGS. 18 and 19. Unit structures in FIGS. 18 and 19 are formed by laminating plural layers having the metal patterns. FIGS. 18 and 19 illustrate examples of unit structures formed by laminating three layers. In other words, a unit structure is formed by a combination of three laminated metal patterns. Note that the three-layer structure is only an example, and the metal pattern layer may be formed of four or more layers. There is concern that a loss increases due to impedance matching with air, but the metal pattern layer may be formed of a single layer or two layers. A unit structure of the metal pattern layer may be configured with plural types of metal patterns as illustrated in FIGS. 18 and 19.

Figure 18A:
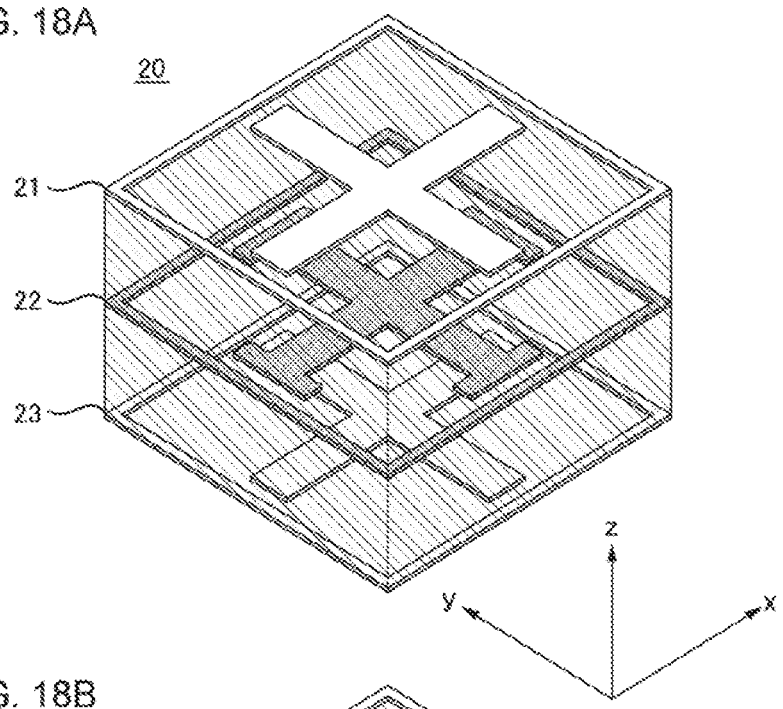
FIG. 18A-18B are diagrams for explaining an example of a unit structure.

FIG. 18 illustrates an example of a parallel-resonator-type unit structure 20. The unit structure 20 in FIG. 18(A) is configured with a metal pattern 21 of the first layer, a metal pattern 22 of the second layer, and a metal pattern 23 of the third layer. The metal pattern 21 of the first layer includes an outer peripheral metal surrounding the outer periphery and a cross-shaped internal metal located therein. The outer peripheral metal and the internal metal are insulated from each other. The metal pattern 22 of the second layer includes an outer peripheral metal surrounding the outer periphery and a cross-shaped internal metal located therein. A line width of each end of the two linear metals forming the cross shape is large. The outer peripheral metal and the internal metal are insulated from each other. The metal pattern 23 of the third layer includes an outer peripheral metal surrounding the outer periphery and a cross-shaped internal metal located therein. The outer peripheral metal and the internal metal are insulated from each other. The metal pattern 21 of the first layer to the metal pattern 23 of the third layer are insulated among each other. A location where a metal pattern is not present is buried with, for example, a dielectric.

Figure 18B:
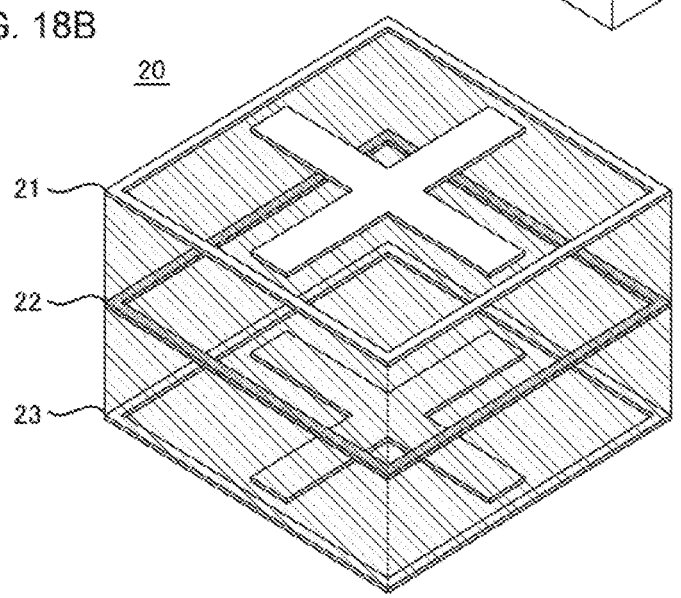

The unit structure 20 in FIG. 18(B) is also configured with a metal pattern 21 of the first layer, a metal pattern 22 of the second layer, and a metal pattern 23 of the third layer. The metal pattern 21 of the first layer includes an outer peripheral metal surrounding the outer periphery and a cross-shaped internal metal located therein. The outer peripheral metal and the internal metal are insulated from each other. The metal pattern 22 of the second layer includes an outer peripheral metal surrounding the outer periphery. The metal pattern 23 of the third layer includes an outer peripheral metal surrounding the outer periphery and a cross-shaped internal metal located therein. The outer peripheral metal and the internal metal are insulated from each other. The metal pattern 21 of the first layer to the metal pattern 23 of the third layer are insulated among each other. A location where a metal pattern is not present is buried with, for example, a dielectric.

Figure 19A:
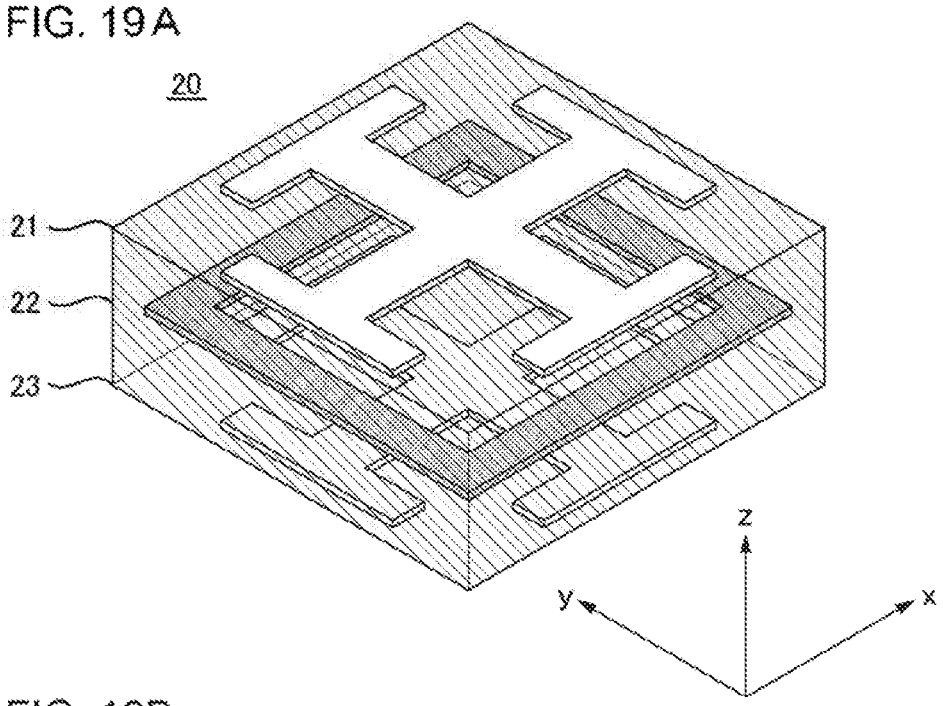
FIG. 19A-19B are diagrams for explaining an example of a unit structure.

FIG. 19 illustrates an example of a series-resonator-type unit structure 20. The unit structure 20 in FIG. 19(A) is configured with a metal pattern 21 of the first layer, a metal pattern 22 of the second layer, and a metal pattern 23 of the third layer. The metal pattern 21 of the first layer includes a cross-shaped internal metal, and a line width of each end of the two linear metals forming the cross shape is large. The metal pattern 22 of the second layer includes a quadrangular annular metal. The metal pattern 23 of the third layer includes a cross-shaped internal metal, and a line width of each end of the two linear metals forming the cross shape is large. The metal pattern 21 of the first layer to the metal pattern 23 of the third layer are insulated among each other. A location where a metal pattern is not present is buried with, for example, a dielectric.

Figure 19B:
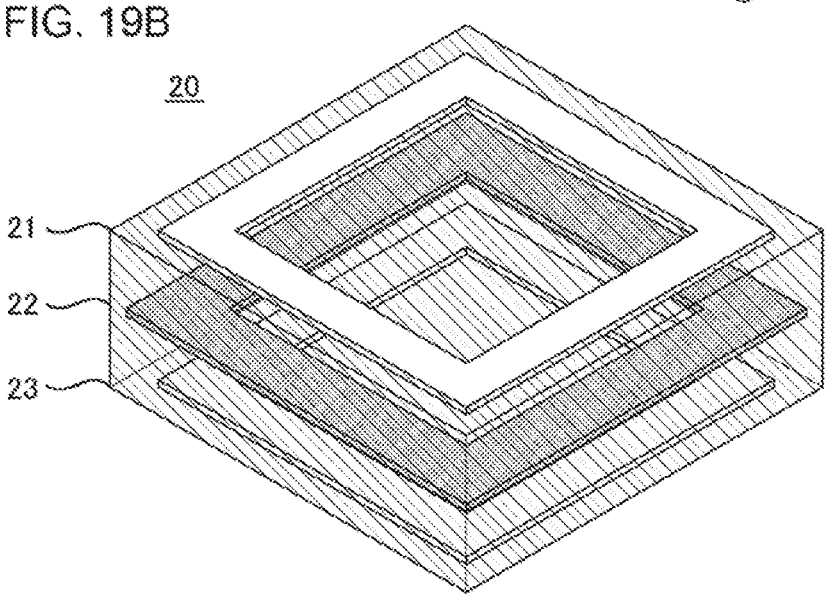

The unit structure 20 in FIG. 19(B) is also configured with a metal pattern 21 of the first layer, a metal pattern 22 of the second layer, and a metal pattern 23 of the third layer. Each of the metal pattern 21 of the first layer, the metal pattern 22 of the second layer, and the metal pattern 23 of the third layer includes a quadrangular annular metal. The metal pattern 21 of the first layer to the metal pattern 23 of the third layer are insulated among each other. A location where a metal pattern is not present is buried with, for example, a dielectric.

Figure 23:
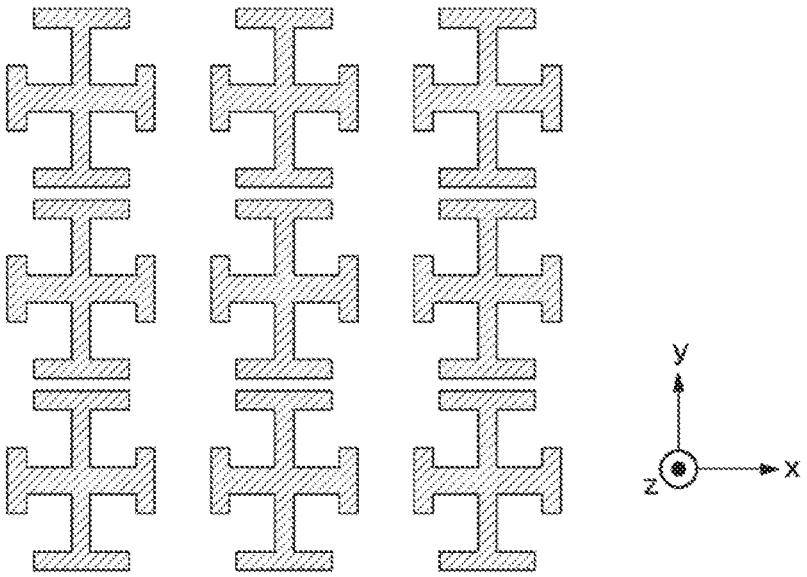
FIG. 23 is a diagram for explaining an example of a metal pattern.

Next, a description will be made of an example of a metal pattern which controls admittance so as to obtain polarized wave dependency. In controlling an admittance value in a wide range from capacitance to inductance, a resonance circuit may be used, and FIG. 23 illustrates an example of a metal pattern for implementing a series resonance circuit. FIG. 23 illustrates a metal pattern in which plural structures in each of which a cross shape is formed by a metal extending in the x axis direction and a metal extending in the y axis direction are arranged. Each of the metal extending in the x axis direction and the metal extending in the y axis direction forms the inductance L. Each of the metal extending in the x axis direction and the metal extending in the y axis direction has line widths of both ends larger than those of other portions, and the capacitance C is formed between patterns adjacent to each other in the x axis direction and the y axis direction. Consequently, a series resonator in the x axis direction and a series resonator in the y axis direction are formed.

Note that the patterns are formed such that values of the inductance L and the capacitance C of the series resonator in the x axis direction are different from values of the inductance L and the capacitance C of the series resonator in the y axis direction. Thus, an admittance value in the x axis direction is different from an admittance value in the y axis direction.

Figure 24:
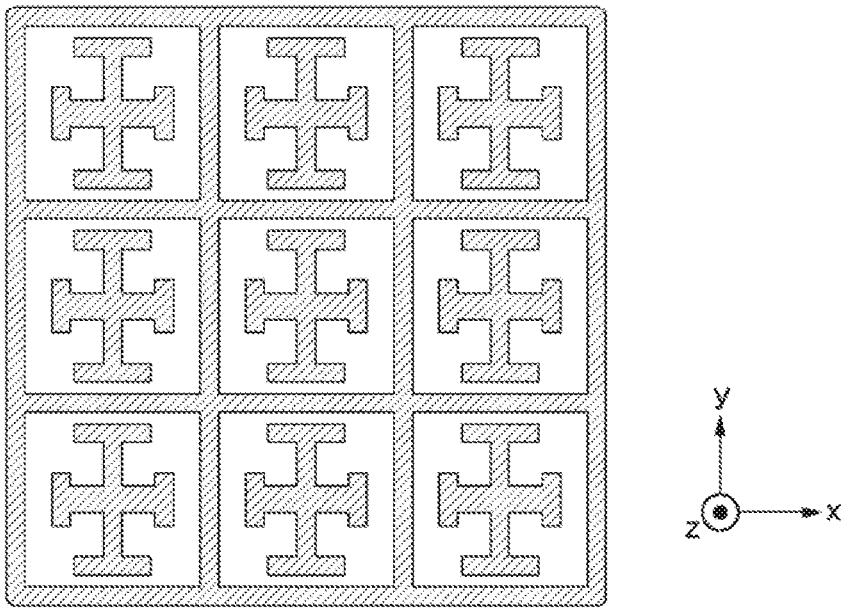
FIG. 24 is a diagram for explaining an example of a metal pattern.

Next, a description will be made of another example of a metal pattern which controls admittance so as to obtain polarized wave dependency. FIG. 24 illustrates an example of a metal pattern for implementing a parallel resonance circuit. FIG. 24 is a diagram illustrating a configuration of a metal pattern in which each cross-shaped structure illustrated in FIG. 23 is surrounded by an annular metal having a side in each of the same directions as the x axis and the y axis. Each of plural annular metals shares one side with an annular metal adjacent thereto.

The metal pattern illustrated in FIG. 24 acts as a parallel resonance circuit due to the inductance L formed by the annular metal and a series resonator portion in which the capacitance C formed as a result of the annular metal and the metal pattern inside the annular metal being adjacent to each other, the inductance L formed by the metal pattern inside the annular metal, and the capacitance C formed as a result of the annular metal and the metal pattern inside the annular metal being adjacent to each other are connected in series to each other in this order in the vertical direction in the figure. Above all, the series resonator portion in which C, L, and C are connected in series to each other operates as a capacitor up to a resonance frequency of a series resonator. Such a parallel resonance circuit is formed to correspond to each of the x axis direction and the y axis direction.

Note that the patterns are formed such that values of the inductance L and the capacitance C of the parallel resonator in the x axis direction are different from values of the inductance L and the capacitance C of the parallel resonator in the y axis direction. Thus, an admittance value in the x axis direction is different from an admittance value in the y axis direction. Therefore, the metal pattern may be used as a metal pattern which configures the polarization control plate 12, and controls admittance so as to obtain direction dependency. In a case where a difference between phase delay amounts in the x axis direction and the y axis direction is 180 degrees, the metal pattern may be used as a structure configuring the polarization control plate which converts radial linearly polarized waves before being incident to the polarization control plate 12 into linearly polarized waves aligned into one direction, and unit structures including the metal pattern illustrated in FIG. 24 may be supposed to be disposed at, for example, positions where the angle θ formed between a line (reference line) connecting the reference point thereof to the second representative point and the representative line is 0 degrees and 180 degrees. In a case where a difference between phase delay amounts in the x axis direction and the y axis direction is 90 degrees, the metal pattern may be used as a structure configuring the polarization control plate which converts radial linearly polarized waves before being incident to the polarization control plate 12 into circularly polarized waves, and unit structures including a metal pattern illustrated in FIG. 25 described below may be supposed to be disposed at, for example, positions where the angle θ formed between a line (reference line) connecting the reference point thereof to the second representative point and the representative line is 45 degrees, 135 degrees, 225 degrees, and 315 degrees.

Figure 25:
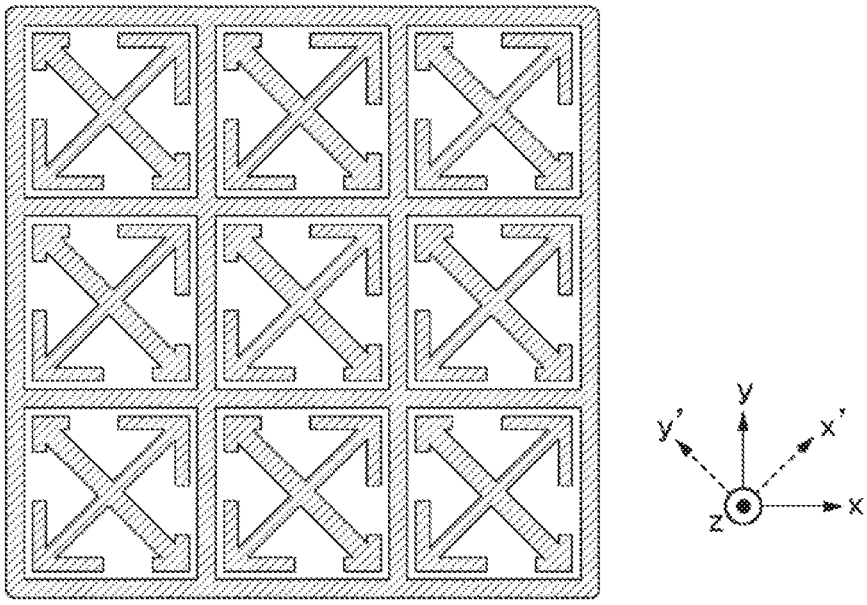
FIG. 25 is a diagram for explaining an example of a metal pattern.

Here, a description will be made of another example of a metal pattern which controls admittance so as to obtain polarized wave. FIG. 25 illustrates an example of a metal pattern for implementing a parallel resonance circuit. The metal pattern in FIG. 25 is different from the metal pattern in FIG. 24 in that a direction of a cross-shaped metal located inside an annular metal differs. The rest configuration is the same.

In FIG. 24, the two lines of the cross-shaped metal respectively extend in the x axis direction and the y axis direction, but, in FIG. 25, two lines of the cross-shaped metal respectively extend in an x' axis direction and a y' axis direction. The x' axis direction and the y' axis direction are directions obtained by respectively rotating the x axis direction and the y axis direction about the z axis by 45 degrees. Thus, in FIG. 24, the parallel resonance circuit is formed to correspond to each of the x axis direction and the y axis direction, but, in FIG. 25, the parallel resonance circuit is formed to correspond to each of the x' axis direction and the y' axis direction. Thus, the metal pattern may be used as a metal pattern causing different phase delay amounts in the x' axis direction and the y' axis direction. In a case where a difference between phase delay amounts in the x' axis direction and the y' axis direction is 180 degrees, the metal pattern may be used as a structure configuring the polarization control plate which converts radial linearly polarized waves before being incident to the polarization control plate 12 into linearly polarized waves aligned into one direction, and unit structures including the metal pattern illustrated in FIG. 25 may be supposed to be disposed at, for example, positions where the angle θ formed between a line (reference line) connecting the reference point thereof to the second representative point and the representative line is 90 degrees and 270 degrees. In a case where a difference between phase delay amounts in the x' axis direction and the y' axis direction is 90 degrees, the metal pattern may be used as a structure configuring the polarization control plate which converts radial linearly polarized waves before being incident to the polarization control plate 12 into circularly polarized waves, and unit structures including a metal pattern illustrated in FIG. 25 described below may be supposed to be disposed at, for example, positions where the angle θ formed between a line (reference line) connecting the reference point thereof to the second representative point and the representative line is 0 degrees, 90 degrees, 180 degrees, and 270 degrees.

Figure 26:
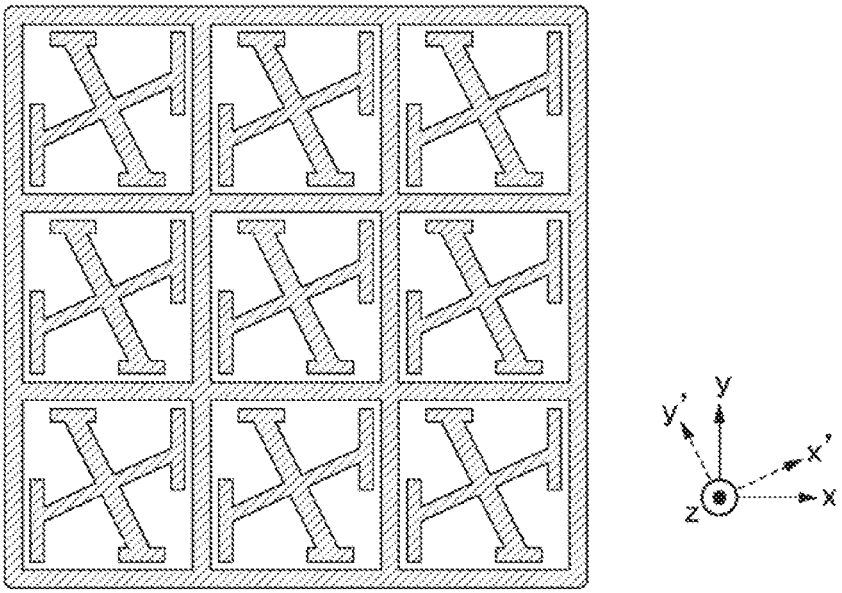
FIG. 26 is a diagram for explaining an example of a metal pattern.

Here, a description will be made of still another example of a metal pattern which controls admittance so as to obtain polarized wave dependency. FIG. 26 illustrates an example of a metal pattern for implementing a parallel resonance circuit. The metal pattern in FIG. 26 is different from the metal pattern in FIG. 24 in that a direction of a cross-shaped metal located inside an annular metal differs. The rest configuration is the same.

In FIG. 24, the two lines of the cross-shaped metal respectively extend in the x axis direction and the y axis direction, but, in FIG. 26, two lines of the cross-shaped metal respectively extend in an x' axis direction and a y' axis direction. The x' axis direction and the y' axis direction are directions obtained by respectively rotating the x axis direction and the y axis direction about the z axis by 22.5 degrees. Thus, in FIG. 24, the parallel resonance circuit is formed to correspond to each of the x axis direction and the y axis direction, but, in FIG. 26, the parallel resonance circuit is formed to correspond to each of the x' axis direction and the y' axis direction. Thus, the metal pattern may be used as a metal pattern causing different phase delay amounts in the x' axis direction and the y' axis direction. In a case where a difference between phase delay amounts in the x' axis direction and the y' axis direction is 180 degrees, the metal pattern may be used as a structure configuring the polarization control plate which converts radial linearly polarized waves before being incident to the polarization control plate 12 into linearly polarized waves aligned into one direction, and unit structures including the metal pattern illustrated in FIG. 26 may be supposed to be disposed at, for example, positions where the angle θ formed between a line (reference line) connecting the reference point thereof to the second representative point and the representative line is 45 degrees and 135 degrees. In a case where a difference between phase delay amounts in the x' axis direction and the y' axis direction is 90 degrees, the metal pattern may be used as a structure configuring the polarization control plate which converts radial linearly polarized waves before being incident to the polarization control plate 12 into circularly polarized waves, and unit structures including a metal pattern illustrated in FIG. 26 may be supposed to be disposed at, for example, positions where the angle θ formed between a line (reference line) connecting the reference point thereof to the second representative point and the representative line is 67.5 degrees, 157.5 degrees, 247.5 degrees, and 337.5 degrees.

Note that the metal patterns illustrated in FIGS. 23 and 26 are configured by arranging plural unit structures having an identical shape, but plural different types of unit structures having different lengths of metal lines, thicknesses of metal lines, gaps between metal lines, areas of metal portions, and the like may be arranged.

In designing the metal pattern layer, C may be increased by using, for example, an inter-digital capacitor as a capacitor portion. L may be increased by using, for example, a meander inductor or a spiral inductor as an inductor portion.

Figure 34:
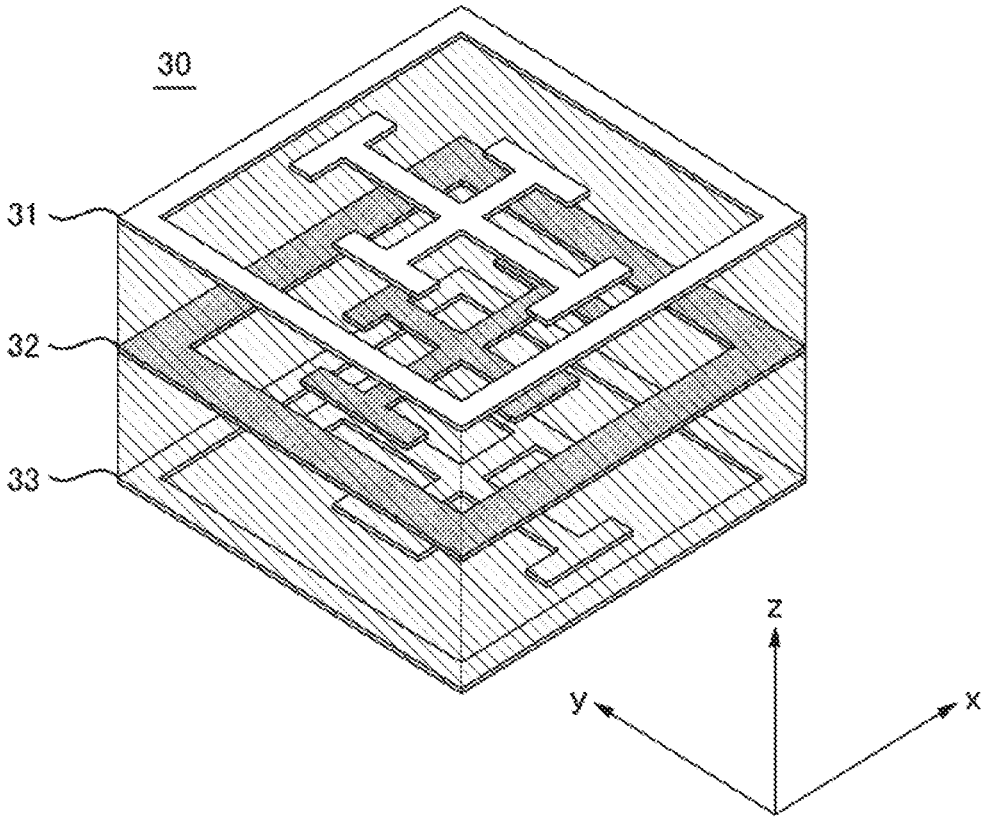
FIG. 34 is a diagram for explaining an example of a unit structure.

Next, a description will be made of an example of a unit structure with reference to FIG. 34. The unit structure in FIG. 34 is formed by laminating plural layers each having the above-described metal pattern. FIG. 34 illustrates an example of the unit structure formed by laminating three layers. In other words, the unit structure is formed by a combination of three laminated metal patterns. Note that the three-layer structure is only an example, and the metal pattern layer may be formed of four or more layers. There is concern that a loss increases due to impedance matching with air, but the metal pattern layer may be formed of a single layer or two layers. A unit structure of the metal pattern layer may be configured with plural types of metal patterns as illustrated in FIG. 34.

FIG. 34 illustrates a parallel-resonator-type unit structure 30. The unit structure 30 is configured with a metal pattern 31 of the first layer, a metal pattern 32 of the second layer, and a metal pattern 33 of the third layer. Each of the metal pattern 31 of the first layer to the metal pattern 33 of the third layer includes an outer peripheral metal surrounding the outer periphery and a cross-shaped internal metal located therein. A line width of each end of the two linear metals forming the cross shape is large. The outer peripheral metal and the internal metal are insulated from each other. The internal cross-shaped metal in each of the metal pattern 31 of the first layer and the metal pattern 33 of the third layer has a linear metal extending in the y axis direction longer than a linear metal extending in the x axis direction. In contrast, the internal cross-shaped metal in each of the metal pattern 32 of the second layer has a linear metal extending in the x axis direction longer than a linear metal extending in the y axis direction. The outer peripheral metal of the metal pattern 32 of the second layer has a width larger than that of each of the outer peripheral metals of the metal pattern 31 of the first layer and the metal pattern 33 of the third layer. The metal pattern 31 of the first layer to the metal pattern 33 of the third layer are insulated among each other. A location where a metal pattern is not present is buried with, for example, a dielectric.

According to the communication apparatus 1 of the present example embodiment described above, the radio wave radiation source 10 having isotropic directivity in the xy plane can be employed. In this case, power of an electromagnetic wave can be supplied to a control plate placed at a short distance from the radio wave radiation source 10 in a wide range of the control plate, and thus a high-directivity beam can be formed. In other words, the communication apparatus 1 forming a high-directivity beam can be implemented with a thin configuration.

According to the communication apparatus 1 of the present example embodiment in which phases of electromagnetic waves are aligned with each other, and radial polarized waves are converted into a single polarized wave after being transmitted, by using the control plates (the phase control plate 11 and the polarization control plate 12) including metal pattern layers, thinning of the communication apparatus 1 is realized compared with a case of using a horn antenna and a dielectric lens.

Note that, in the above description, an example in which the phase control plate 11 is located further toward the radio wave radiation source 10 side than the polarization control plate 12, that is, an example in which the radio wave radiation source 10, the phase control plate 11, and the polarization control plate 12 are disposed in this order. As a modification example, the polarization control plate 12 may be located further toward the radio wave radiation source 10 side than the phase control plate 11. In other words, the radio wave radiation source 10, the polarization control plate 12, and the phase control plate 11 may be disposed in this order. The premise is also the same for the following example embodiments. In this case, the same advantageous effect can also be achieved.

Figure 35:
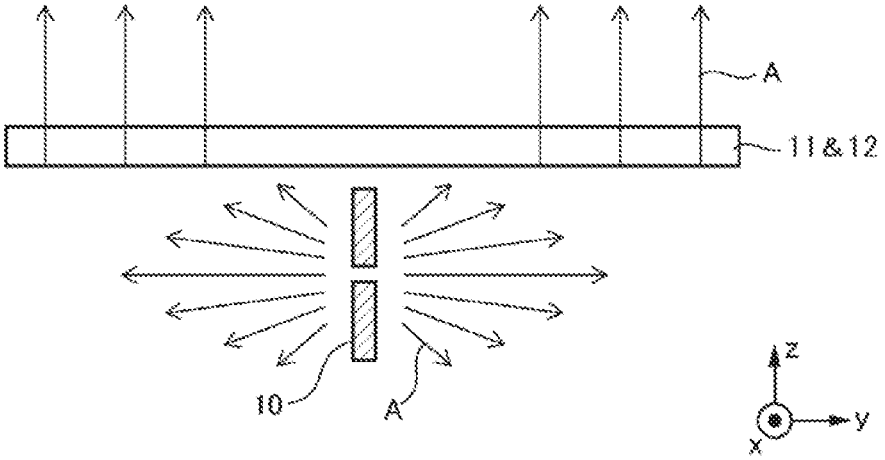
FIG. 35 is an example of the overall schematic diagram of the communication apparatus of the present example embodiment.

In the above description, a description has been made of an example in which the phase control plate 11 and the polarization control plate 12 are implemented by different metal pattern layers, but the phase control plate 11 and the polarization control plate 12 may be implemented by an identical metal pattern layer. In other words, the phase control plate 11 and the polarization control plate 12 may be a single control plate. This being possible can be understood from the fact that the principle of polarization control is based on phase control having direction dependency, and a fundamental principle is the same as the principle of implementing a phase control plate. FIG. 35 is a schematic diagram illustrating the communication apparatus 1 in a case where the phase control plate 11 and the polarization control plate 12 are implemented by using an identical metal pattern layer. The premise is also the same for all the following example embodiments.

In the figures illustrating an example in which the phase control plate 11 and the polarization control plate 12 are implemented by different metal pattern layers, the phase control plate 11 and the polarization control plate 12 are separated from each other, but may be integrated with each other. The premise is also the same for the following example embodiments. In this case, the same advantageous effect can also be achieved.

In the above description, a linear dipole antenna has been described as an example of the radio wave radiation source 10, but, as a modification example, antennae having other shapes such as a bowtie dipole antenna or a dipole antenna using the concept of meta-material may be used. The premise is also the same for the following example embodiments. For example, in a second example embodiment, other shapes such as a bowtie shape into which a linear conductor of a monopole antenna is modified or a mushroom shape into which a linear conductor is modified by using the concept of meta-material may be used. In this case, the same advantageous effect can also be achieved.

Second Example Embodiment

Figure 27:
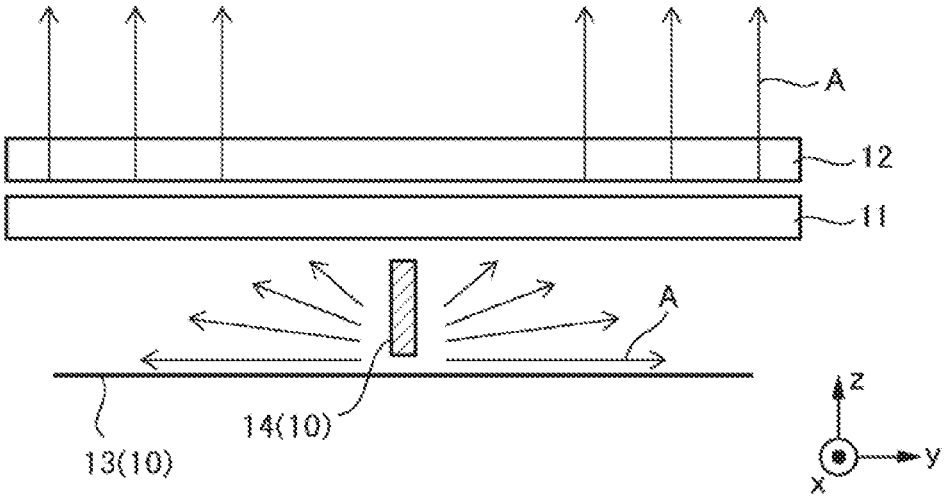
FIG. 27 is an example of the overall schematic diagram of the communication apparatus of the present example embodiment.

FIG. 27 is a schematic diagram illustrating a communication apparatus 1 of the present example embodiment. In the communication apparatus 1 of the present example embodiment, a monopole antenna (linear conductor) is used as the radio wave radiation source 10, and a metal member (conductive plate) 13 is disposed on an opposite side to control plates (the phase control plate 11 and the polarization control plate 12) with a linear conductor 14 interposed therebetween. Both of the linear conductor 14 and the metal member 13 function as the radio wave radiation source 10. The linear conductor 14 is disposed to be substantially perpendicular to the control plates (the phase control plate 11 and the polarization control plate 12). The metal member 13 is located near the linear conductor 14, and is disposed to be substantially parallel to the phase control plate. The metal member 13 also functions as a blocking member which blocks an electromagnetic wave radiated from the radio wave radiation source 10 from being directed toward the opposite side to the control plates (the phase control plate 11 and the polarization control plate 12). A planar shape, a size, and the like of the metal member 13 are design matter.

Figure 28:
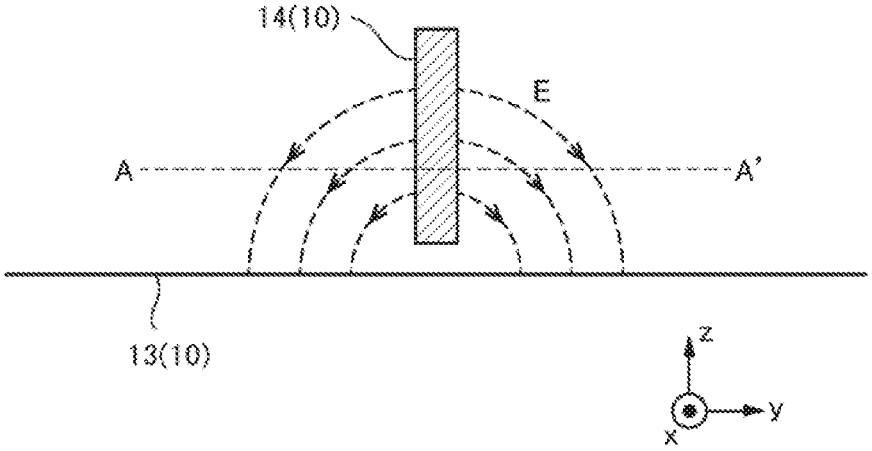
FIG. 28 is a diagram for explaining a function of the communication apparatus of the present example embodiment.

FIG. 28 is a diagram corresponding to FIG. 2, and illustrates an aspect of an electric field of the radio wave radiation source 10 (monopole antenna) of the present example embodiment. The electric fields E of the radio wave radiation source 10 are distributed as illustrated in FIG. 28, and, in a case where, for example, a section taken along the line A-A' is extracted, the electric fields E are distribution as illustrated in FIG. 3. In other words, it can be seen that the electric fields E are radially distributed. An aspect of an electric field or a magnetic field shows directivity similar to that of a dipole antenna in the upper side (z axis positive direction) of the figure, above an image plane (metal member 13) of the radio wave radiation source 10 (monopole antenna). Thus, even in a case where the dipole antenna (radio wave radiation source 10) of the communication apparatus 1 of the first example embodiment is replaced with the monopole antenna (radio wave radiation source 10), the same advantageous effect as in the first example embodiment can be achieved. According to the communication apparatus 1 of the present example embodiment, electromagnetic wave radiation toward the lower side (a side on which the control plates (the phase control plate 11 and the polarization control plate 12) are not present) of the figure, below the image plane (metal member 13), is suppressed, and thus a larger amount of power can be introduced into the control plates (the phase control plate 11 and the polarization control plate 12).

Third Example Embodiment

Figure 29:
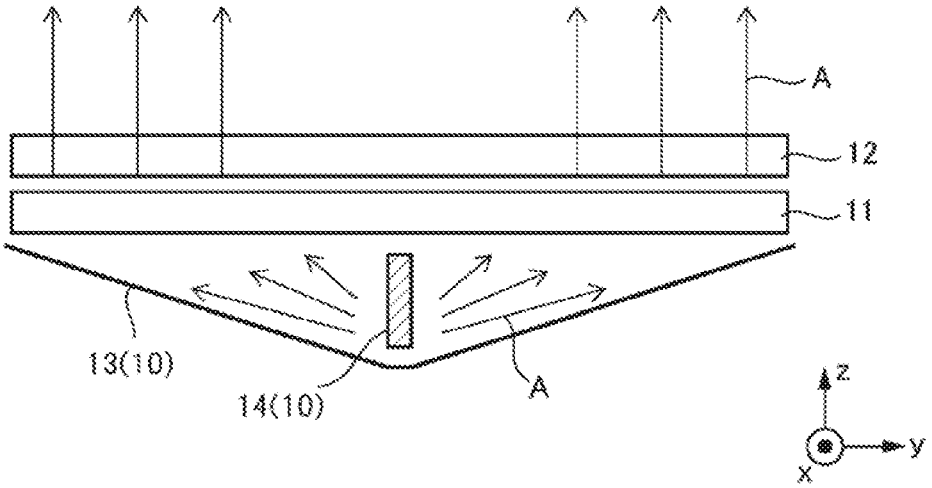
FIG. 29 is an example of the overall schematic diagram of the communication apparatus of the present example embodiment.

FIG. 29 is a schematic diagram illustrating a communication apparatus 1 of the present example embodiment. In the communication apparatus 1 of the present example embodiment, a monopole antenna is used as the radio wave radiation source 10. A metal member 13 is disposed on an opposite side to control plates (the phase control plate 11 and the polarization control plate 12) with a linear conductor 14 interposed therebetween. Both of the linear conductor 14 and the metal member 13 function as the radio wave radiation source 10.

In the present example embodiment, a shape of the metal member 13 is a cup shape of which a diameter gradually increases, and the linear conductor 14 is located therein. The control plates (the phase control plate 11 and the polarization control plate 12) are located to close an opening at an opening portion of the cup shape. Note that the control plates are not necessarily required to completely close the opening, and the control plates may be separated from the metal member 13. The metal member 13 guides an electromagnetic wave radiated from the radio wave radiation source 10 to the opening portion, that is, toward the control plates (the phase control plate 11 and the polarization control plate 12). A planar shape, a size, and the like of the metal member 13 are design matter.

Figure 30:
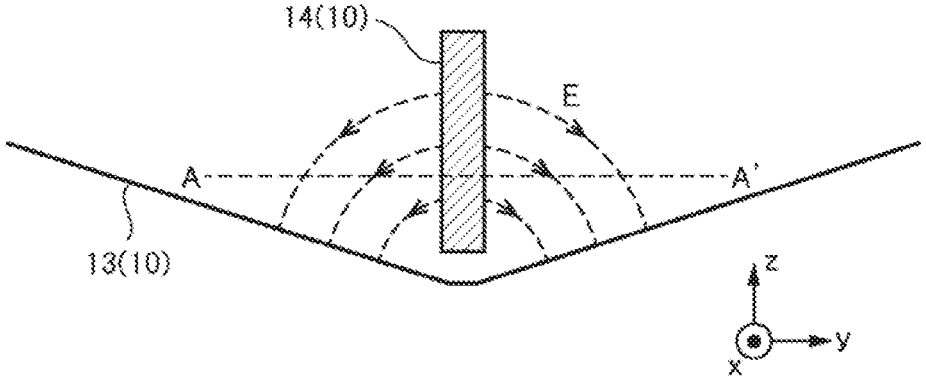
FIG. 30 is a diagram for explaining a function of the communication apparatus of the present example embodiment.

FIG. 30 is a diagram corresponding to FIG. 2, and illustrates an aspect of an electric field of the radio wave radiation source 10 (monopole antenna) of the present example embodiment. The electric fields of the radio wave radiation source 10 are distributed as illustrated in FIG. 30, and, in a case where, for example, a section taken along the line A-A' is extracted, the electric fields are distribution as illustrated in FIG. 3. In other words, it can be seen that the electric fields are radially distributed. An aspect of an electric field or a magnetic field shows directivity similar to that of a dipole antenna in the upper side (z axis positive direction) of the figure, above an image plane (metal member 13) of the radio wave radiation source 10 (monopole antenna). Thus, even in a case where the dipole antenna (radio wave radiation source 10) of the communication apparatus 1 of the first example embodiment is replaced with the monopole antenna (radio wave radiation source 10) of the present example embodiment, the same advantageous effect as in the first example embodiment can be achieved. According to the communication apparatus 1 of the present example embodiment, electromagnetic wave radiation toward the lower side (a side on which the control plates (the phase control plate 11 and the polarization control plate 12) are not present) of the figure, below the image plane (metal member 13), is suppressed, and thus a larger amount of power can be introduced into the control plates (the phase control plate 11 and the polarization control plate 12).

Figure 31:
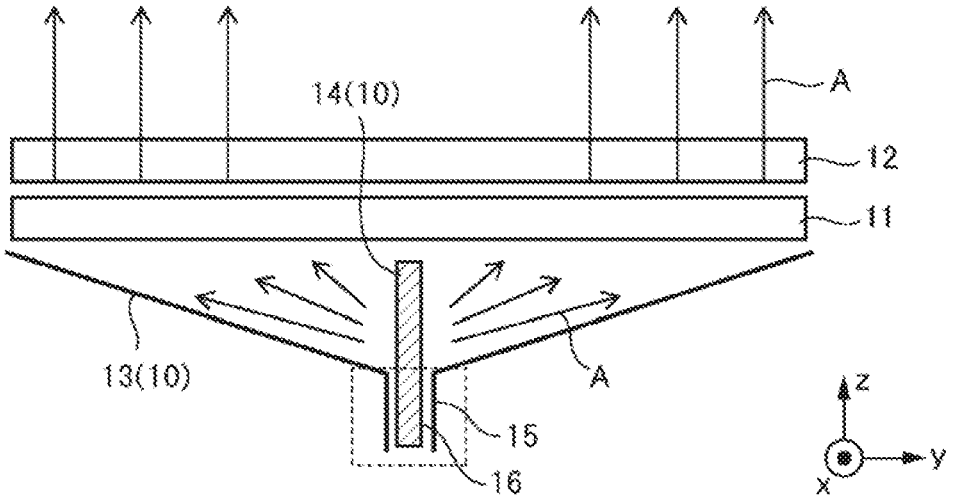
FIG. 31 is an example of the overall schematic diagram of the communication apparatus of the present example embodiment.

FIG. 31 illustrates an example of implementing the communication apparatus 1 of the present example embodiment. A portion surrounded by a dashed line functions as a power supply portion. A power supply portion 15 is connected to the metal member 13, and a power supply portion 16 is connected to the linear conductor 14.

Fourth Example Embodiment

Figure 20A:
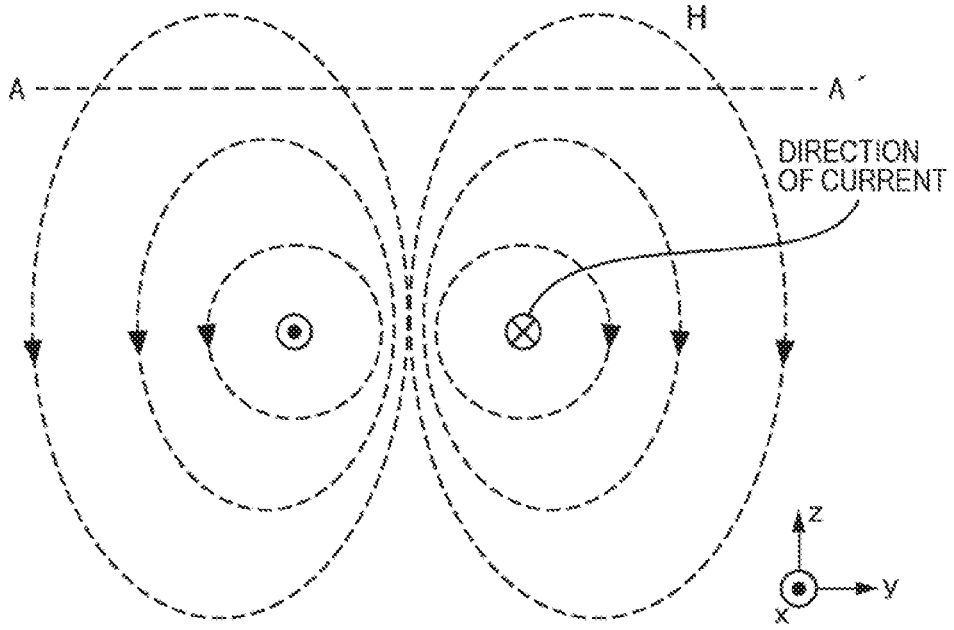
FIG. 20A-20B are diagrams for explaining a function of the communication apparatus of the present example embodiment.
Figure 20B:
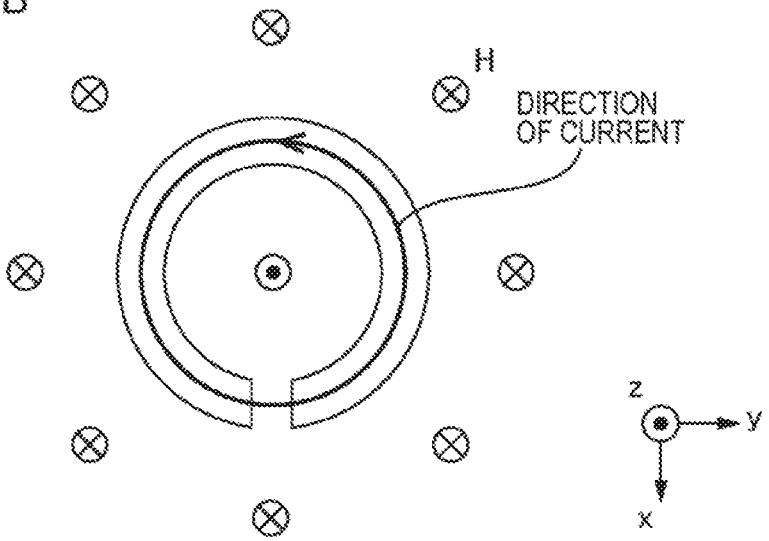
Figure 32:
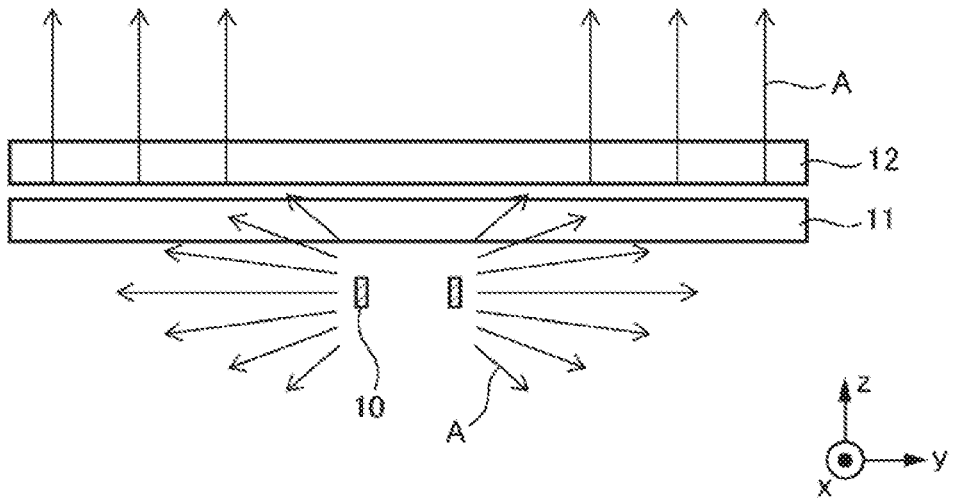
FIG. 32 is an example of the overall schematic diagram of the communication apparatus of the present example embodiment.

FIG. 32 is a schematic diagram illustrating a communication apparatus 1 of the present example embodiment. In the communication apparatus 1 of the present example embodiment, a small loop antenna is used as the radio wave radiation source 10. An aspect of an electric field and a magnetic field in a case where the small loop antenna is used is illustrated in FIG. 20. This is an aspect in which a magnetic field and an electric field are replaced with each other in the aspect (refer to FIGS. 2 and 3) of an electric field and a magnetic field of the dipole antenna, and shows directivity similar to that of the dipole antenna. As illustrated in FIGS. 20(A) and 20(B), the loop antenna is an antenna in which a loop is formed by a linear metal. In a case where a current as illustrated flows through the loop antenna, a magnetic field is generated as illustrated. The magnetic field is formed to surround the periphery of the linear metal (loop antenna). In other words, in the present example embodiment, magnetic fields H of the radio wave radiation source 10 are distributed as illustrated in FIG. 20, and, in a case where, for example, a section taken along the line A-A' is extracted, the magnetic fields H are distributed as if the electric fields E in FIG. 3 are replaced with the magnetic fields H. In other words, it can be seen that the magnetic fields H are radially distributed. An aspect of an electric field and a magnetic field is an aspect in which a magnetic field and an electric field are replaced with each other in the aspect of an electric field and a magnetic field of the dipole antenna, and shows directivity similar to that of the dipole antenna. Thus, even in a case where the dipole antenna (radio wave radiation source 10) of the communication apparatus 1 of the first example embodiment is replaced with the small loop antenna (radio wave radiation source 10), the same advantageous effect as in the first example embodiment can be achieved. In a case of the present example embodiment, the radio wave radiation source 10 is thin (a length thereof in the z direction is small), and is thus advantageous in thinning.

Hereinafter, examples of reference embodiments are added.

1. A communication apparatus including:

a radio wave radiation source that radiates an electromagnetic wave;

a phase control plate that is disposed near the radio wave radiation source; and a polarization control plate that is disposed to be parallel to the phase control plate, in which, in the phase control plate, a phase of a transmitted electromagnetic wave differs according to a distance from a first representative point on the phase control plate, and in which, in the polarization control plate, a polarization state change given to a transmitted electromagnetic wave at a reference point differs according to an angle formed between a representative line connecting a second representative point on the polarization control plate to an edge of the polarization control plate, and a reference line connecting the second representative point to the reference point on the polarization control plate.

2. The communication apparatus according to 1, in which the phase control plate reduces a phase delay amount between an incidence surface and an emission surface of the phase control plate toward an edge of the phase control plate from the first representative point.

3. The communication apparatus according to 1 or 2, in which, in the polarization control plate, a difference between a phase delay amount given to an electromagnetic wave having a linearly polarized wave in a direction of an angle of $\theta/2$ degrees and a phase delay amount given to an electromagnetic wave having a linearly polarized wave in a direction of an angle of $(\theta/2+90)$ degrees is 180 degrees at the reference point on a line of which the angle formed between the representative line and the reference line is $\theta$.

4. The communication apparatus according to 1 or 2, in which, in the polarization control plate, a difference between a phase delay amount given to an electromagnetic wave having a linearly polarized wave in a direction of an angle of $(\theta+45)$ degrees and a phase delay amount given to an electromagnetic wave having a linearly polarized wave in a direction of an angle of $(\theta+135)$ degrees is 90 degrees at the reference point located at a position of which the angle formed between the representative line and the reference line is $\theta$.

5. The communication apparatus according to any one of 1 to 4, in which the phase control plate is configured by two-dimensionally arranging plural types of unit structures configured to include metals, and a unit structure group deviating phases of transmitted electromagnetic waves by an identical amount surrounds the periphery of the first representative point.

6. The communication apparatus according to any one of 1 to 5, in which the polarization control plate is configured by two-dimensionally arranging plural types of unit structures configured to include metals, and unit structure groups giving an identical polarization state change to transmitted electromagnetic waves are radially arranged from the second representative point.

7. The communication apparatus according to any one of 1 to 6, in which the phase control plate and the polarization control plate are integrated into a single control plate.

8. The communication apparatus according to any one of 1 to 7, in which each of the phase control plate and the polarization control plate is configured with plural metal pattern layers.

9. The communication apparatus according to 8, in which the metal pattern layers are meta-surfaces.

10. The communication apparatus according to any one of 1 to 9, in which, in a case where a wavelength at an operation frequency of the radio wave radiation source is indicated by $\lambda$, the phase control plate is disposed at a position within a distance of $10\lambda$ from the radio wave radiation source.

11. The communication apparatus according to any one of 1 to 10, in which the radio wave radiation source supplies 1/10 or more of radiated power to the phase control plate.

12. The communication apparatus according to any one of 1 to 11, in which, in a case where a distance between the radio wave radiation source and the phase control plate is $L_1$, the radio wave radiation source is able to supply power up to a position separated from the first representative point on the phase control plate by $L_1/2$.

13. The communication apparatus according to any one of 1 to 12, in which the radio wave radiation source has isotropic directivity in a plane substantially parallel to the phase control plate.

14. The communication apparatus according to any one of 1 to 12, in which the radio wave radiation source is a dipole antenna disposed to be substantially perpendicular to the phase control plate.

15. The communication apparatus according to any one of 1 to 12, in which the radio wave radiation source is configured with a linear conductor disposed to be substantially perpendicular to the phase control plate and a conductive plate disposed near the linear conductor and disposed to be substantially parallel to the phase control plate on an opposite side to the phase control plate.

16. The communication apparatus according to any one of 1 to 12, further including:

a metal member having a cup shape of which a diameter gradually increases toward an opening, in which the phase control plate is located at the opening.

17. The communication apparatus according to any one of 1 to 12, in which the radio wave radiation source is a loop antenna.

18. The communication apparatus according to 5, in which a difference in a phase amount deviated between unit structures of a unit structure group deviating phases of transmitted electromagnetic waves by an identical amount is 45 degrees or less.

19. The communication apparatus according to 6, in which a difference in a phase delay between two axes, deviated between unit structures of a unit structure group giving an identical polarization state change to transmitted electromagnetic waves is 45 degrees or less.

This application is based upon and claims the benefit of priority from Japanese Patent Application No. 2016-228680, filed on Nov. 25, 2016; the entire contents of which are incorporated herein by reference.

What is claimed is:

1. A communication apparatus comprising:

a radio wave radiation source that radiates an electromagnetic wave;

a phase control plate that is disposed near the radio wave radiation source; and a polarization control plate that is disposed to be parallel to the phase control plate, wherein, in the phase control plate, a phase of a transmitted electromagnetic wave differs according to a distance from a first representative point on the phase control plate, wherein, in the polarization control plate, a polarization state change given to a transmitted electromagnetic wave at a reference point differs according to an angle formed between a representative line connecting a second representative point on the polarization control plate to an edge of the polarization control plate, and a reference line connecting the second representative point to the reference point on the polarization control plate, and wherein, in the polarization control plate, a difference between a phase delay amount given to an electromagnetic wave having a linearly polarized wave in a direction of an angle of $\theta/2$ degrees and a phase delay amount given to an electromagnetic wave having a linearly polarized wave in a direction of an angle of $(\theta/2+90)$ degrees is 180 degrees at the reference point on a line of which the angle formed between the representative line and the reference line is $\theta$.

2. The communication apparatus according to claim 1, wherein the phase control plate reduces a phase delay amount between an incidence surface and an emission surface of the phase control plate toward an edge of the phase control plate from the first representative point.

3. The communication apparatus according to claim 1, wherein the phase control plate is configured by two-dimensionally arranging a plurality of types of unit structures configured to include metals, and a unit structure group deviating phases of transmitted electromagnetic waves by an identical amount surrounds the periphery of the first representative point.

4. The communication apparatus according to claim 3, wherein a difference in a phase amount deviated between unit structures of a unit structure group deviating phases of transmitted electromagnetic waves by an identical amount is 45 degrees or less.

5. The communication apparatus according to claim 1, wherein the phase control plate and the polarization control plate are integrated into a single control plate.

6. The communication apparatus according to claim 1, wherein each of the phase control plate and the polarization control plate is configured with a plurality of metal pattern layers.

7. The communication apparatus according to claim 6, wherein the metal pattern layers are meta-surfaces.

8. The communication apparatus according to claim 1, wherein, in a case where a wavelength at an operation frequency of the radio wave radiation source is indicated by $\lambda$, the phase control plate is disposed at a position within a distance of $10\lambda$ from the radio wave radiation source.

9. The communication apparatus according to claim 1, wherein the radio wave radiation source supplies 1/10 or more of radiated power to the phase control plate.

10. The communication apparatus according to claim 1, wherein, in a case where a distance between the radio wave radiation source and the phase control plate is $L_1$, the radio wave radiation source is able to supply power up to a position separated from the first representative point on the phase control plate by $L_1/2$.

11. The communication apparatus according to claim 1, wherein the radio wave radiation source has isotropic directivity in a plane substantially parallel to the phase control plate.

12. The communication apparatus according to claim 1, wherein the radio wave radiation source is a dipole antenna disposed to be substantially perpendicular to the phase control plate.

13. The communication apparatus according to claim 1, wherein the radio wave radiation source is configured with a linear conductor disposed to be substantially perpendicular to the phase control plate and a conductive plate disposed near the linear conductor and disposed to be substantially parallel to the phase control plate on an opposite side to the phase control plate.

14. The communication apparatus according to claim 1, further comprising:

a metal member having a cup shape of which a diameter gradually increases toward an opening, wherein the phase control plate is located at the opening.

15. The communication apparatus according to claim 1, wherein the radio wave radiation source is a loop antenna.

16. A communication apparatus comprising:

a radio wave radiation source that radiates an electromagnetic wave;

a phase control plate that is disposed near the radio wave radiation source; and a polarization control plate that is disposed to be parallel to the phase control plate, wherein, in the phase control plate, a phase of a transmitted electromagnetic wave differs according to a distance from a first representative point on the phase control plate, wherein, in the polarization control plate, a polarization state change given to a transmitted electromagnetic wave at a reference point differs according to an angle formed between a representative line connecting a second representative point on the polarization control plate to an edge of the polarization control plate, and a reference line connecting the second representative point to the reference point on the polarization control plate, and wherein, in the polarization control plate, a difference between a phase delay amount given to an electromagnetic wave having a linearly polarized wave in a direction of an angle of $(\theta+45)$ degrees and a phase delay amount given to an electromagnetic wave having a linearly polarized wave in a direction of an angle of (θ+135) degrees is 90 degrees at the reference point located.

17. The communication apparatus according to claim 16, wherein the phase control plate reduces a phase delay amount between an incidence surface and an emission surface of the phase control plate toward an edge of the phase control plate from the first representative point.

18. The communication apparatus according to claim 16, wherein the phase control plate is configured by two-dimensionally arranging a plurality of types of unit structures configured to include metals, and a unit structure group deviating phases of transmitted electromagnetic waves by an identical amount surrounds the periphery of the first representative point.

19. The communication apparatus according to claim 18, wherein a difference in a phase amount deviated between unit structures of a unit structure group deviating phases of transmitted electromagnetic waves by an identical amount is 45 degrees or less.

20. The communication apparatus according to claim 16, wherein the phase control plate and the polarization control plate are integrated into a single control plate.

21. The communication apparatus according to claim 16, wherein each of the phase control plate and the polarization control plate is configured with a plurality of metal pattern layers.

22. The communication apparatus according to claim 21, wherein the metal pattern layers are meta-surfaces.

23. The communication apparatus according to claim 16, wherein, in a case where a wavelength at an operation frequency of the radio wave radiation source is indicated by λ, the phase control plate is disposed at a position within a distance of 10λ from the radio wave radiation source.

24. The communication apparatus according to claim 16, wherein the radio wave radiation source supplies 1/10 or more of radiated power to the phase control plate.

25. The communication apparatus according to claim 16, wherein, in a case where a distance between the radio wave radiation source and the phase control plate is $L_1$, the radio wave radiation source is able to supply power up to a position separated from the first representative point on the phase control plate by $L_1/2$.

26. The communication apparatus according to claim 16, wherein the radio wave radiation source has isotropic directivity in a plane substantially parallel to the phase control plate.

27. The communication apparatus according to claim 16, wherein the radio wave radiation source is a dipole antenna disposed to be substantially perpendicular to the phase control plate.

28. The communication apparatus according to claim 16, wherein the radio wave radiation source is configured with a linear conductor disposed to be substantially perpendicular to the phase control plate and a conductive plate disposed near the linear conductor and disposed to be substantially parallel to the phase control plate on an opposite side to the phase control plate.

29. The communication apparatus according to claim 16, further comprising:

a metal member having a cup shape of which a diameter gradually increases toward an opening, wherein the phase control plate is located at the opening.

30. The communication apparatus according to claim 16, wherein the radio wave radiation source is a loop antenna.

31. A communication apparatus comprising:

a radio wave radiation source that radiates an electromagnetic wave;

a phase control plate that is disposed near the radio wave radiation source; and a polarization control plate that is disposed to be parallel to the phase control plate, wherein, in the phase control plate, a phase of a transmitted electromagnetic wave differs according to a distance from a first representative point on the phase control plate, wherein, in the polarization control plate, a polarization state change given to a transmitted electromagnetic wave at a reference point differs according to an angle formed between a representative line connecting a second representative point on the polarization control plate to an edge of the polarization control plate, and a reference line connecting the second representative point to the reference point on the polarization control plate, and wherein the polarization control plate is configured by two-dimensionally arranging a plurality of types of unit structures configured to include metals, and unit structure groups giving an identical polarization state change to transmitted electromagnetic waves are radially, arranged from the second representative point.

32. The communication apparatus according to claim 31, wherein a difference in a phase delay between two axes, deviated between unit structures of a unit structure group giving an identical polarization state change to transmitted electromagnetic waves is 45 degrees or less.

33. The communication apparatus according to claim 31, wherein the phase control plate reduces a phase delay amount between an incidence surface and an emission surface of the phase control plate toward an edge of the phase control plate from the first representative point.

34. The communication apparatus according to claim 31, wherein the phase control plate is configured by two-dimensionally arranging a plurality of types of unit structures configured to include metals, and a unit structure group deviating phases of transmitted electromagnetic waves by an identical amount surrounds the periphery of the first representative point.

35. The communication apparatus according to claim 30, wherein a difference in a phase amount deviated between unit structures of a unit structure group deviating phases of transmitted electromagnetic waves by an identical amount is 45 degrees or less.

36. The communication apparatus according to claim 31, wherein the phase control plate and the polarization control plate are integrated into a single control plate.

37. The communication apparatus according to claim 31, wherein each of the phase control plate and the polarization control plate is configured with a plurality of metal pattern layers.

38. The communication apparatus according to claim 37, wherein the metal pattern layers are meta-surfaces.

39. The communication apparatus according to claim 31, wherein, in a case where a wavelength at an operation frequency of the radio wave radiation source is indicated by λ, the phase control plate is disposed at a position within a distance of 10λ from the radio wave radiation source.

40. The communication apparatus according to claim 31, wherein the radio wave radiation source supplies 1/10 or more of radiated power to the phase control plate.

41. The communication apparatus according to claim 31, wherein, in a case where a distance between the radio wave radiation source and the phase control plate is $L_1$, the radio wave radiation source is able to supply power up to a position separated from the first representative point on the phase control plate by $L_1/2$.

42. The communication apparatus according to claim 31, wherein the radio wave radiation source has isotropic directivity in a plane substantially parallel to the phase control plate.

43. The communication apparatus according to claim 31, wherein the radio wave radiation source is a dipole antenna disposed to be substantially perpendicular to the phase control plate.

44. The communication apparatus according to claim 31, wherein the radio wave radiation source is configured with a linear conductor disposed to be substantially perpendicular to the phase control plate and a conductive plate disposed near the linear conductor and disposed to be substantially parallel to the phase control plate on an opposite side to the phase control plate.

45. The communication apparatus according to claim 31, further comprising:

a metal member having a cup shape of which a diameter gradually increases toward an opening, wherein the phase control plate is located at the opening.

46. The communication apparatus according to claim 31, wherein the radio wave radiation source is a loop antenna.

* * * * *